US009206359B2

(12) United States Patent
Litz et al.

(10) Patent No.: US 9,206,359 B2
(45) **Date of Patent: *Dec. 8, 2015**

(54) METHODS FOR UPGRADING OF CONTAMINATED HYDROCARBON STREAMS

(71) Applicants: Auterra, Inc., Schenectady, NY (US); Cenovus Energy Inc., Calgary (CA)

(72) Inventors: Kyle E. Litz, Ballston Spa, NY (US); Jennifer L. Vreeland, Troy, NY (US); Jonathan P. Rankin, Galway, NY (US); Mark N. Rossetti, Castleton, NY (US); Tracey M. Jordan, Valley Falls, NY (US); Trent A. McCaskill, Mechanicville, NY (US); Erica Shipley, Scotia, NY (US); Sarah Clickner, Melrose, NY (US)

(73) Assignees: AUTERRA, INC., Schenectady, NY (US); CENOVUS ENERGY INC. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/287,916

(22) Filed: May 27, 2014

(65) Prior Publication Data

US 2014/0339136 A1 Nov. 20, 2014

Related U.S. Application Data

(63) Continuation-in-part of application No. 13/560,584, filed on Jul. 27, 2012, now Pat. No. 8,764,973, which is a continuation-in-part of application No. 12/904,446, filed on Oct. 14, 2010, now Pat. No.

(Continued)

(51) Int. Cl.
*C10G 29/22* (2006.01)
*C10G 17/06* (2006.01)

(Continued)

(52) U.S. Cl.
CPC ..... *C10G 29/22* (2013.01); *C10G 19/073* (2013.01); *C10G 19/08* (2013.01); *C10G 21/00* (2013.01);

(Continued)

(58) Field of Classification Search
None
See application file for complete search history.

(56) References Cited

U.S. PATENT DOCUMENTS 2,764,525 A 9/1956 Kocal et al.
2,910,434 A 10/1959 Hess et al.

(Continued)

FOREIGN PATENT DOCUMENTS

WO 0181715 A2 11/2001
WO 2008153633 A1 12/2008

(Continued)

OTHER PUBLICATIONS

Jain, Suman L., et al. Rehenium-Catalyzed Highly Efficient Oxidations of Tertiary Nitrogen Compounds to N-Oxides Using Sodium Percarbonate as Oxygen Source. Synlett, 2006, No. 16, pp. 2661-2663. Published on Web Sep. 22, 2006.

(Continued)

*Primary Examiner* — Tam M Nguyen
(74) *Attorney, Agent, or Firm* — Schmeiser, Olsen & Watts, LLP

(57) ABSTRACT

A method of upgrading a heteroatom-containing hydrocarbon feed by removing oxidized-heteroatom contaminants is disclosed. The method includes contacting the oxidized-heteroatom-containing hydrocarbon feed with a caustic and a selectivity promoter, and removing the heteroatom contaminants from the heteroatom-containing hydrocarbon feed.

20 Claims, 9 Drawing Sheets

Related U.S. Application Data

8,241,490, which is a continuation-in-part of application No. 12/933,898, filed as application No. PCT/US08/82095 on Oct. 31, 2001, now Pat. No. 8,394,261, and application No. 12/904,446, and a continuation-in-part of application No. 12/888,049, filed on Sep. 22, 2010, now Pat. No. 8,298,404, and application No. 13/560,584, and a continuation-in-part of application No. 12/888,049, filed on Sep. 22, 2010, now Pat. No. 8,298,404.

(60) Provisional application No. 61/039,619, filed on Mar. 26, 2008.

(51) Int. Cl.

| | |
|---|---|
| ***C10G 27/04*** | (2006.01) |
| ***C10G 53/12*** | (2006.01) |
| ***C10G 53/14*** | (2006.01) |
| ***C10G 19/073*** | (2006.01) |
| ***C10G 19/08*** | (2006.01) |
| ***C10G 21/00*** | (2006.01) |

(52) U.S. Cl.

CPC ..... *C10G 27/04* (2013.01); *C10G 53/12* (2013.01); *C10G 53/14* (2013.01); *C10G 2300/201* (2013.01); *C10G 2300/308* (2013.01); *C10G 2300/805* (2013.01)

(56) References Cited

U.S. PATENT DOCUMENTS

| | | | |
|---|---|---|---|
| 2,987,470 | A | 6/1961 | Turken |
| 3,136,714 | A | 6/1964 | Gibson et al. |
| 3,164,545 | A | 1/1965 | Mattox |
| 3,505,210 | A | 4/1970 | Wallace et al. |
| 3,558,747 | A | 1/1971 | Meltsner |
| 3,565,793 | A | 2/1971 | Herbstman et al. |
| 3,668,117 | A | 6/1972 | Patel et al. |
| 3,819,509 | A | 6/1974 | Wolk et al. |
| 3,847,797 | A | 11/1974 | Pasternak et al. |
| 3,945,914 | A | 3/1976 | Yoo et al. |
| 3,948,759 | A | 4/1976 | King et al. |
| 3,957,620 | A | 5/1976 | Fukui et al. |
| 3,960,706 | A | 6/1976 | McCollum et al. |
| 3,960,708 | A | 6/1976 | McCollum et al. |
| 3,964,995 | A | 6/1976 | Wolk et al. |
| 4,119,528 | A | 10/1978 | Baird et al. |
| 4,127,470 | A | 11/1978 | Baird et al. |
| 4,192,736 | A | 3/1980 | Kluksdahl |
| 4,224,140 | A | 9/1980 | Fujimori et al. |
| 4,374,949 | A | 2/1983 | Massey et al. |
| 4,437,980 | A | 3/1984 | Heredy et al. |
| 4,444,655 | A | 4/1984 | Shiroto et al. |
| 4,591,426 | A | 5/1986 | Krasuk et al. |
| 4,645,589 | A | 2/1987 | Krambeck et al. |
| 4,665,261 | A | 5/1987 | Mazurek |
| 4,923,682 | A | 5/1990 | Roberts et al. |
| 5,064,523 | A | 11/1991 | Kretschmar et al. |
| 5,166,118 | A | 11/1992 | Kretschmar et al. |
| 5,288,681 | A | 2/1994 | Gatsis |
| 5,637,739 | A | 6/1997 | Jacobsen et al. |
| 6,087,662 | A | 7/2000 | Wilt et al. |
| 6,160,193 | A | 12/2000 | Gore |
| 6,245,223 | B1 | 6/2001 | Gorbaty et al. |
| 6,368,495 | B1 | 4/2002 | Kocal et al. |
| 6,403,526 | B1 | 6/2002 | Lussier et al. |
| 6,406,616 | B1 | 6/2002 | Rappas et al. |
| 6,471,852 | B1 | 10/2002 | Mark et al. |
| 6,544,409 | B2 | 4/2003 | DeSouza |
| 6,547,957 | B1 | 4/2003 | Sudhakar et al. |
| 6,673,236 | B2 | 1/2004 | Stanciulescu et al. |
| 6,846,406 | B2 | 1/2005 | Canos et al. |
| 7,144,499 | B2 | 12/2006 | Han et al. |
| 7,153,414 | B2 | 12/2006 | DeSouza |
| 7,179,368 | B2 | 2/2007 | Rabion et al. |
| 7,314,545 | B2 | 1/2008 | Karas et al. |
| 7,371,318 | B2 | 5/2008 | Corma Canos et al. |
| 7,374,666 | B2 | 5/2008 | Wachs |
| 7,598,426 | B2 | 10/2009 | Fang et al. |
| 7,648,625 | B2 | 1/2010 | Bhan et al. |
| 7,678,264 | B2 | 3/2010 | Bhan |
| 7,749,374 | B2 | 7/2010 | Bhan et al. |
| 7,790,021 | B2 | 9/2010 | Kocal et al. |
| 7,875,185 | B2 | 1/2011 | Zhang |
| 7,918,992 | B2 | 4/2011 | Bhan |
| 8,088,706 | B2 | 1/2012 | Domokos et al. |
| 8,197,671 | B2 | 6/2012 | Rankin et al. |
| 8,241,490 | B2 | 8/2012 | Litz et al. |
| 8,298,404 | B2 | 10/2012 | Litz et al. |
| 8,372,777 | B2 | 2/2013 | Bhan et al. |
| 8,394,261 | B2 | 3/2013 | Litz et al. |
| 8,409,541 | B2 | 4/2013 | Reynolds et al. |
| 8,444,061 | B2 | 5/2013 | Van Den Berg et al. |
| 8,450,538 | B2 | 5/2013 | Bhan et al. |
| 8,481,450 | B2 | 7/2013 | Bhan |
| 8,492,599 | B2 | 7/2013 | Bhan et al. |
| 8,530,370 | B2 | 9/2013 | Donaho et al. |
| 8,562,817 | B2 | 10/2013 | Milam et al. |
| 8,562,818 | B2 | 10/2013 | Milam et al. |
| 8,597,608 | B2 | 12/2013 | Reynolds et al. |
| 8,608,946 | B2 | 12/2013 | Bhan et al. |
| 8,764,973 | B2 | 7/2014 | Litz et al. |
| 8,877,013 | B2 | 11/2014 | Litz et al. |
| 8,877,043 | B2 | 11/2014 | Litz et al. |
| 8,894,843 | B2 | 11/2014 | Rankin et al. |
| 8,961,779 | B2 | 2/2015 | Litz et al. |
| 9,061,273 | B2 | 6/2015 | Litz et al. |
| 2002/0177522 | A1 | 11/2002 | Alexander, IV et al. |
| 2002/0189975 | A1 | 12/2002 | DeSouza |
| 2003/0000867 | A1 | 1/2003 | Reynolds |
| 2003/0149317 | A1 | 8/2003 | Rendina |
| 2004/0108252 | A1 | 6/2004 | DeSouza |
| 2004/0178121 | A1 | 9/2004 | Leyshon et al. |
| 2004/0222134 | A1 | 11/2004 | deSouza |
| 2004/0238410 | A1 | 12/2004 | Inoue et al. |
| 2005/0023188 | A1 | 2/2005 | Connor |
| 2006/0011510 | A1 | 1/2006 | Toshima et al. |
| 2006/0154814 | A1 | 7/2006 | Zanibelli et al. |
| 2006/0180501 | A1 | 8/2006 | Da Silva et al. |
| 2006/0231456 | A1 | 10/2006 | Bhan |
| 2006/0231457 | A1 | 10/2006 | Bhan |
| 2006/0234876 | A1 | 10/2006 | Bhan |
| 2007/0000810 | A1 | 1/2007 | Bhan et al. |
| 2007/0051667 | A1 | 3/2007 | Martinie et al. |
| 2007/0295646 | A1 | 12/2007 | Bhan et al. |
| 2008/0083650 | A1 | 4/2008 | Bhan et al. |
| 2008/0087575 | A1 | 4/2008 | Bhan et al. |
| 2008/0121565 | A1 | 5/2008 | Yoo et al. |
| 2008/0135449 | A1 | 6/2008 | Bhan et al. |
| 2008/0308463 | A1 | 12/2008 | Keckler et al. |
| 2009/0065399 | A1 | 3/2009 | Kocal et al. |
| 2009/0188836 | A1 | 7/2009 | Bhan et al. |
| 2010/0055005 | A1 | 3/2010 | Bhan et al. |
| 2010/0098602 | A1 | 4/2010 | Bhan et al. |
| 2011/0000823 | A1 | 1/2011 | Hamad et al. |
| 2011/0011771 | A1 | 1/2011 | Litz et al. |
| 2011/0031164 | A1 | 2/2011 | Litz et al. |
| 2011/0108464 | A1 | 5/2011 | Rankin et al. |
| 2011/0178346 | A1 | 7/2011 | Milam et al. |
| 2011/0192762 | A1 | 8/2011 | Wellington et al. |
| 2011/0294657 | A1 | 12/2011 | Soled et al. |
| 2012/0055843 | A1 | 3/2012 | Bourane et al. |
| 2012/0055844 | A1 | 3/2012 | Bourane et al. |
| 2012/0055845 | A1 | 3/2012 | Bourane et al. |
| 2012/0055849 | A1 | 3/2012 | Bourane et al. |
| 2012/0067777 | A1 | 3/2012 | Litz et al. |
| 2012/0074040 | A1 | 3/2012 | Koseoglu et al. |
| 2012/0152804 | A1 | 6/2012 | Koseoglu et al. |
| 2012/0285864 | A1 | 11/2012 | Rankin et al. |
| 2012/0285866 | A1 | 11/2012 | Litz et al. |
| 2013/0015104 | A1 | 1/2013 | Al-Hajji et al. |
| 2013/0026062 | A1 | 1/2013 | Al-Shahrani et al. |

(56) References Cited

U.S. PATENT DOCUMENTS

| | | | |
|---|---|---|---|
| 2013/0026071 | A1 | 1/2013 | Koseoglu et al. |
| 2013/0026075 | A1 | 1/2013 | Koseoglu et al. |
| 2013/0028822 | A1 | 1/2013 | Bourane et al. |
| 2013/0030236 | A1 | 1/2013 | Koseoglu et al. |
| 2013/0048543 | A1 | 2/2013 | Litz et al. |
| 2013/0075305 | A1 | 3/2013 | Al-Shafei et al. |
| 2013/0130892 | A1 | 5/2013 | Litz |
| 2013/0171039 | A1 | 7/2013 | Graham et al. |
| 2013/0185044 | A1 | 7/2013 | Chen et al. |
| 2013/0315793 | A1 | 11/2013 | Koseoglu et al. |
| 2013/0334103 | A1 | 12/2013 | Bourane et al. |
| 2014/0131256 | A1 | 5/2014 | Litz et al. |
| 2014/0291199 | A1 | 10/2014 | Litz et al. |

FOREIGN PATENT DOCUMENTS

| | | | |
|---|---|---|---|
| WO | 2009120238 | A1 | 10/2009 |
| WO | 2012039910 | A1 | 3/2012 |
| WO | 2012051009 | A1 | 4/2012 |
| WO | 2013188144 | A1 | 12/2013 |
| WO | 2014018082 | A1 | 12/2013 |

OTHER PUBLICATIONS

McKillop, Alexander, et al. Further Functional-Group Oxidations Using Sodium Perborate. Tetrahedron, vol. 45, No. 11, pp. 3299 to 3306, 1989. Published in Great Britain.

Varma, Rajender S., et al. The Urea-Hydrogen Peroxide Complex: Solid-State Oxidative Protocols for Hydroxylated Aldehydes and Ketones (Dakin Reaction), Nitriles, Sulfides, and Nitrogen Heterocycles. Organic Letters, 1999, vol. 1, No. 2, pp. 189-191. Published on Web May 29, 1999.

Jana, Nirmal K., et al. Phase-Vanishing Methodology for Efficient Bromination, Alkylation, Epoxidation, and Oxidation Reactions of Organic Substrates. Organic Letters, 2003, vol. 5, No. 21, pp. 3787-3790. Published on Web Sep. 16, 2003.

Khodaei, Mohammad Mehdi, et al. H2O2/Tf2O System: An Efficient Oxidizing Reagent for Selective Oxidation of Sulfanes. Synthesis, 2008; No. 11, pp. 1682-1684. Published on Web Apr. 11, 2008.

Kim, Sung Soo, et al. A Mild and Highly Efficient Oxidation of Sulfide to Sulfoxides with Periodic Acid Catalyzed by FeCl3. Synthesis, 2002, No. 17, pp. 2484-2486. Published USA Feb. 12, 2002.

Qian, Weixing, et al. Efficient and Highly Selective Oxidation of Sulfides to Sulfoxides in the Presence of an Ionic Liquid Containing Hypervalent Iodine. Synlett, 2006, No. 5, pp. 709-712. Published on Web Mar. 9, 2006.

Matteucci, Mizio, et al. Mild and Highly Chemoselective Oxidation of Thioethers Mediated by Sc(OTf)3. Organic Letters, 2003, vol. 5, No. 3, 235-237. Published on Web Jan. 11, 2003.

Mba, Myriam, et al. C3-Symmetric Ti(IV) Triphenolate Amino Complexes as Sulfoxidation Catalysts with Aqueous Hydrogen Peroxide. Organic Letters, 2007, vol. 9, No. 1, pp. 21-24. Published on Web Dec. 9, 2006.

Drago, Carmelo, et al. Vanadium-Catalyzed Sulfur Oxidation/Kinetic Resolution in the Synthesis of Enantiomerically Pure Alkyl Aryl Sulfoxides. Agnew. Chem. Int. Ed, 2005, 44, pp. 7221-7223. Published on Web Oct. 17, 2005.

Egami, Hiromichi, et al. Fe(salan)-Catalyzed Asymmetric Oxidation of Sulfides with Hydrogen Peroxide in Water. J. Am. Chem. Soc., 2007, vol. 129, No. 29, pp. 8940-8941. Published on Web Jun. 29, 2007.

Sun, Jiangtao, et al. Efficient Asymmetric Oxidation of Sulfides and Kinetic Resolution of Sulfoxides Catalyzed by a Vanadium-Salan System. J. Org. Chem., 2004, vol. 69, No. 24, pp. 8500-8503. Published on Web Oct. 28, 2004.

Karimi, Babak, et al. Selective Oxidation of Sulfides to Sulfoxides Using 30% Hydrogen Peroxide Catalyzed with a Recoverable Silica-Based Tungstate Interphase Catalyst. Organic Letters, 2005, vol. 7, No. 4, pp. 625-628. Published on Web Jan. 25, 2005.

Ali, Mohammed Hashmat, et al. Ceric Ammonium Nitrate Catalyzed Oxidation of Sulfides to Sulfoxides. Synthesis, 2007, No. 22, pp. 3507-3511. Published on Web Oct. 16, 2007.

Imada, Yasushi, et al. Flavin Catalyzed Oxidations of Sulfides and Amines with Molecular Oxygen. J. Am Chem. Soc., 2003, vol. 125, No. 10, pp. 2868-2869. Published on Web Feb. 12, 2003.

Varma, Rajender S., et al. The Urea-Hydrogen Peroxide Complex: Solid-State Oxidatives Protocols for Hydroxylated Aldehydes and Ketones (Dakin Reaction), Nitriles, Sulfides, and Nitrogen Heterocycles. Organic Letters, 1999, vol. 1, No. 2, pp. 189-191. Published on Web May 29, 1999.

Shaabani, Ahmad, et al. Green oxidations. The use of potassium permanganate supported on manganese dioxide. Tetrahedron, 2004, 60, pp. 11415-11420. Published on Web Oct. 12, 2004.

Wozniak, Lucyna A., et al. Oxidation in Organophosphorus Chemistry: Potassium Peroxymonosulphate. Tetrahedron, 1999, 40, pp. 2637-2640. Received Oct. 13, 1998; Accepted Feb. 3, 1999. No published date.

Akasaka, Takeshi, et al. Singlet Oxygen Oxidation of Organophosphorus Compounds: Cooxidation of Olefin with Phosphadioxirane. Quimica Nova, 1993, 16, pp. 325-327. No published date or location.

Milner, O.I., et al. Determination of Trace Materials in Crudes and Other Petroleum Oils. Analytical Chemistry, vol. 24, No. 11. Published Nov. 1952, USA.

Aida, Tetsuo, et al. Development of an Efficient Coal-Desulfurization process: "Oxy-Alkalinolysis". Technical Report Resource Conference: American Chemical Society symposium on coal liquefaction, pp. 328-334. Kansas City, MO USA. Published Sep. 1, 1982 Ames Lab., IA (USA); Advanced Fuel Research, Inc., East Hartford, CT (USA).

Aida, Tetsuo, et al. Reaction of Dibenzothiophene Sulfone with Alkoxides. Tetrahedron Letters (1983), vol. 24, No. 34, pp. 3543-3546. USA.

Oviedo, Alberto, et al. Deoxydesulfurization of sulfones derived from dibenzothiophene using nickel compounds. Journal of Molecular Catalysis A: Chemical, (2008) 293, pp. 65-71. USA.

Ripin, D.H., et al., "pKa's of Inorganic and Oxo-Acids", [http://evans.harvard.edu/pdf/evans_pka_table.pdf]; published Apr. 11, 2005, accessed Apr. 29, 2013 6 pages.

Application No. PCT/US2008/82095, International Search Report and the Written Opinion of the International Searching Authority, or the Declaration dated Mar. 20, 2009. 12 pages.

Application No. PCT/US2011/50159, International Search Report and the Written Opinion of the International Searching Authority dated Jan. 12, 2012, 11 pages.

Application No. PCT/US2011/54840, International Search Report and the Written Opinion of the International Searching Authority dated Mar. 12, 2012, 8 pages.

Application No. PCT/US2011/70243, International Search Report and the Written Opinion of the International Searching Authority dated Feb. 25, 2013, 40 pages.

Office Action (Mail Date Aug. 19, 2013) for U.S. Appl. No. 13/493,240—Filing Date Jun. 11, 2012.

Office Action (Mail Date Jan. 3, 2014) for U.S. Appl. No. 13/493,240—Filing Date Jun. 11, 2012.

Office Action (Mail Date Mar. 20, 2014) for U.S. Appl. No. 13/493,240—Filing Date Jun. 11, 2012.

Notice of Allowance (Mail Date Jul. 17, 2014) for U.S. Appl. No. 13/493,240—Filing Date Jun. 11, 2012.

Office Action (Mail Date Jun. 25, 2014) for U.S. Appl. No. 14/246,597—Filing Date Apr. 7, 2014.

Notice of Allowance (Mail Date Aug. 14, 2014) for U.S. Appl. No. 14/246,597—Filing Date Apr. 7, 2014.

Office Action (Mail Date Jun. 6, 2013) for U.S. Appl. No. 13/660,371—Filing Date Oct. 25, 2012.

Office Action (Mail Date Nov. 12, 2013) for U.S. Appl. No. 13/660,371—Filing Date Oct. 25, 2012.

Notice of Allowance (Mail Date Jun. 24, 2014 for U.S. Appl. No. 13/660,371—Filing Date Oct. 25, 2012.

Application No. PCT/US2013/43843, International Search Report and the Written Opinion of the International Searching Authority dated Aug. 27, 2013, 7 pages.

(56) References Cited

OTHER PUBLICATIONS

Canadian Office Action for Appln. No. 2,719,058, mailed on Dec. 31, 2014.
Korean Office Action Translation for KR Appln. No. 2009-7024832.
Office Action (Mail Date Mar. 20, 2012) for U.S. Appl. No. 12/598,474—Filing Date Apr. 23, 2010.
Office Action (Mail Date Oct. 15, 2012) for U.S. Appl. No. 12/598,474—Filing Date Apr. 23, 2010.
Office Action (Mail Date Sep. 11, 2014) for U.S. Appl. No. 12/598,474—Filing Date Apr. 23, 2010.
Advisory Action (Mail Date Dec. 10, 2014) for U.S. Appl. No. 12/598,474—Filing Date Apr. 23, 2010.
Office Action (Mail Date May 11, 2015) for U.S. Appl. No. 12/598,474—Filing Date Apr. 23, 2010.
International Search Report and Written Opinion (mail date Aug. 4, 2015) for PCT Application No. PCT/US15/31461.
International Search Report and Written Opinion (mail date Aug. 5, 2015) for PCT Application No. PCT/US15/32417.

Fig. 1

Nitrogen Oxidation States

| -3 | -1 | 0 | +3 | +5 |
|---|---|---|---|---|
| $NH_3$ ammonia<br>$R_3N$ amines | N-oxides | N elemental | nitro compounds | nitrate |

Sulfur Oxidation States

| -2 | 0 | +2 | +4 | +6 |
|---|---|---|---|---|
| $H_2S$ hydrogen sulfide<br>R-S-R thioethers, thiophenes | S elemental<br>R-S-R sulfoxides | sulfones | sulfonates<br>sulfite | sulfate |

Phosphorus Oxidation States

| -3 | -1 | 0 | +1 | +3 | +5 |
|---|---|---|---|---|---|
| $PH_3$ phosphine<br>$R_3P$ trialkyl phosphines<br>tetraalkyl phosphonium | phosphine oxides | P elemental | phosphenic acid salts | phosphonic acid salts<br>phosphite esters | $P_2O_5$<br>phosphate esters<br>phosphate |

METHODS FOR UPGRADING OF CONTAMINATED HYDROCARBON STREAMS

CROSS-REFERENCE TO RELATED APPLICATIONS

This application is a continuation in part of Ser. No. 13/560,584, filed Jul. 27, 2012, now U.S. Pat. No. 8,764,973, entitled Methods for Upgrading of Contaminated Hydrocarbon Streams, which is a continuation in part of Ser. No. 12/904,446, filed Oct. 14, 2010, now U.S. Pat. No. 8,241,490, entitled Methods for Upgrading of Contaminated Hydrocarbon Streams, which is a continuation in part of Ser. No. 12/933,898, filed Sep. 22, 2010, entitled Sulfoxidation Catalysts and Method of Using the Same), which claims priority under 35 USC 371 based upon PCT/US08/82095, entitled Sulfoxidation Catalysts and Method of Using the Same), which claims priority to provisional patent application 61/039,619, entitled Sulfoxidation Catalysts and Method of Using the Same); and this application is a continuation in part of Ser. No. 12/888,049, now U.S. Pat. No. 8,298,404, filed Sep. 22, 2010, entitled Reaction System and Products Therefrom, the disclosure of each is hereby incorporated by reference to the extent not inconsistent with the present disclosure.

BACKGROUND

As is well known in the industry, crude oil contains heteroatom contaminants including, but not limited to, sulfur, nitrogen, phosphorus, nickel, vanadium, and iron and acidic oxygenates in quantities that negatively impact the refinery processing of the crude oil fractions. Light crude oils or condensates contain heteroatoms in concentrations as low as 0.001 wt %. In contrast, heavy crude oils contain heteroatoms as high as 5-7 wt %. The heteroatom content of crude oil increases with increasing boiling point and the heteroatom content increases with decreasing API gravity. These contaminants must be removed during refining operations to meet the environmental regulations for the final product specifications (e.g., gasoline, diesel, fuel oil) or to prevent the contaminants from decreasing catalyst activity, selectivity, and lifetime in downstream refining operations. Contaminants such as sulfur, nitrogen, phosphorus, nickel, vanadium, iron, and total acid number (TAN) in the crude oil fractions negatively impact these downstream processes, and others, including hydrotreating, hydrocracking and FCC to name just a few. These contaminants are present in the crude oil fractions in various organic hydrocarbon molecules and in various concentrations.

Many heteroatom contaminants appear in hydrocarbon streams in both oxidized and unoxidized form. For example, sulfur can appear in oxidized form as, for example, a sulfoxide, sulfone, or sulfonate, or in unoxidized form as, for example, a thiophene. Naturally occurring hydrocarbon streams include both oxidized and unoxidized heteroatoms, including both oxidized and unoxidized forms of sulfur. The oxidized heteroatom content of a hydrocarbon stream may also be increased through artificial processes. FIG. 1 describes a table of available oxidation states for organic heteroatom compounds.

Sulfur is widely recognized as the most egregious heteroatom contaminant as a result of the environmental hazard caused by its release into the environment after combustion. It is believed, sulfur oxides from combustion (known collectively as $SO_x$ emissions) contribute to the formation of acid rain and also to the reduction of the efficiency of catalytic converters in automobiles. Furthermore, sulfur compounds are thought to ultimately increase the particulate content of combustion products. Nitrogen, phosphorus, and other heteroatom contaminants present similar environmental risks.

A variety of methods have been implemented for removing sulfur compounds either from fuels before combustion or from emission gases afterward. Most refineries employ hydrodesulfurization (HDS) as the predominant process for removing sulfur from hydrocarbon streams. HDS remains a cost-effective option for light streams with sulfur levels up to about 2% (w/w) elemental sulfur, but the environmental and economic benefits of HDS are offset in very heavy and sour (>2% elemental sulfur) streams because the energy input to the reaction, the high pressures and the amount of hydrogen necessary to remove the sulfur paradoxically create a substantial $CO_2$ emission problem.

Because of these issues, reduction of contaminants and, in particular, of the sulfur content in hydrocarbon streams has become a major objective of environmental legislation worldwide. Sulfur is regulated in the United States for on-road diesel at a maximum concentration of 15 ppm. By October 2012, sulfur specifications will be 15 ppm for non-road, locomotive, and marine diesel fuel. In the European Union that specification is expected to tighten to 10 ppm in January 2011 for diesels intended for inland waterways and for on-road and off-road diesel operated equipment. In China, the on-road diesel specification will be 10 ppm by 2012. Currently the tightest specifications in the world are in Japan, where the on-road diesel specification is 10 ppm.

Refiners typically use catalytic hydrodesulfurizing ("HDS", commonly referred to as "hydrotreating") methods to lower the sulfur content of hydrocarbon fuels, decrease the total acid number, and increase the API gravity. In HDS, a hydrocarbon stream that is derived from petroleum distillation is treated in a reactor that operates at temperatures ranging between 575 and 750° F. (about 300 to about 400° C.), a hydrogen pressure that ranges between 430 to 14,500 psi (3000 to 10,000 kPa or 30 to 100 atmospheres) and hourly space velocities ranging between 0.5 and 4 $h^{-1}$. Dibenzothiophenes in the feed react with hydrogen when in contact with a catalyst arranged in a fixed bed that comprises metal sulfides from groups VI and VIII (e.g., cobalt and molybdenum sulfides or nickel and molybdenum sulfides) supported on alumina. Because of the operating conditions and the use of hydrogen, these methods can be costly both in capital investment and operating costs.

As is currently known, HDS or hydrotreating may provide a treated product in compliance with the current strict sulfur level targets. However, due to the presence of sterically hindered refractory sulfur compounds such as substituted dibenzothiophenes, the process is not without issues. For example, it is particularly difficult to eliminate traces of sulfur using such catalytic processes when the sulfur is contained in molecules such as dibenzothiophene with alkyl substituents in position 4-, or 4- and 6-positions of the parent ring. Attempts to completely convert these species, which are more prevalent in heavier stocks such as diesel fuel and fuel oil, have resulted in increased equipment costs, more frequent catalyst replacements, degradation of product quality due to side reactions, and continued inability to comply with the strictest sulfur requirements for some feeds.

This has prompted many to pursue non-hydrogen alternatives to desulfurization, such as oxydesulfurization. One attempt at solving the problem discussed above includes selectively desulfurizing dibenzothiophenes contained in the hydrocarbon stream by oxidizing the dibenzothiophenes into a sulfone in the presence of an oxidizing agent, followed by optionally separating the sulfone compounds from the rest of the hydrocarbon stream and further reacting the sulfones with a caustic to remove the sulfur moiety from the hydrocarbon fragment.

Oxidation has been found to be beneficial because oxidized sulfur compounds can be removed using a variety of separation processes that rely on the altered chemical properties such as the solubility, volatility, and reactivity of the sulfone compounds. An important consideration in employing oxidation is chemical selectivity. Selective oxidation of sulfur heteroatom moieties without oxidizing the plethora of olefins and benzylic hydrocarbons found in crude oils, refinery intermediates, and refinery products remains a significant challenge. One selective sulfoxidation method and system is disclosed in International Publication Number WO 2009/120238 A1, to Litz et al. The inventors of the present disclosure have further discovered that the catalyst of the above-mentioned international publication number is further capable of oxidizing additional heteroatoms, including, but not limited to nitrogen and phosphorus found as naturally abundant contaminants in crude oils, refinery intermediates, and refinery products as organic heteroatom-containing compounds. FIG. 1 describes a table of available oxidation states for organic heteroatom compounds.

Another concern with heteroatom oxidation lies in the fate of the oxidized organic heteroatom compounds produced. If the oxidized organic heteroatom compounds are hydrotreated, they may be converted back to the original heteroatom compounds thereby regenerating the original problem. The feed heteroatom content may be likely to be in the range of 0% to 10% by weight heteroatom. Heteroatoms, on average, comprise about 15 wt % of substituted and unsubstituted organic heteroatom molecules. Therefore, up to 67 wt % of the oil may be removed as oxidized organic heteroatom extract if not removed from the organic molecules. For a typical refinery processing 40,000 barrels per day of crude oil, up to 27,000 barrels per day of oxidized organic heteroatom oil will be generated, which is believed to be too much to dispose conventionally as a waste product. Further, the disposal of oxidized organic heteroatom oil also wastes valuable hydrocarbons, which could theoretically be recycled if an efficient process were available.

A considerable challenge presented to heteroatom removal remains the removal of the oxidized heteroatom fragment from the oxidized organic heteroatom compounds found in naturally occurring hydrocarbons or created by oxidation of the initial organic heteroatom species, without producing substantial oxygenated by-product. Therefore, a need exists for methods and systems for upgrading heteroatom-contaminated hydrocarbon feed streams by removing heteroatom contaminants from hydrocarbon streams with the added benefit of decreasing the total acid number and increasing the API gravity of the resulting product relative to the contaminated hydrocarbon feed stream.

SUMMARY OF THE DISCLOSURE

The present disclosure is directed to systems and methods for upgrading hydrocarbon streams by decreasing the content of undesired heteroatom contaminants, including, but not limited to, sulfur, nitrogen, phosphorus, nickel, vanadium, iron.

BRIEF DESCRIPTION OF THE DRAWINGS

The features of the disclosure are set forth in the appended claims. The disclosure itself, however, will be best understood by reference to the following detailed description of illustrative embodiments when read in conjunction with the accompanying drawings, wherein:

FIG. 1 is a graphic representation of the various oxidation states of certain heteroatoms, in accordance with embodiments of the present disclosure.

DETAILED DESCRIPTION OF THE PRESENTLY PREFERRED EMBODIMENTS

Figure 2:
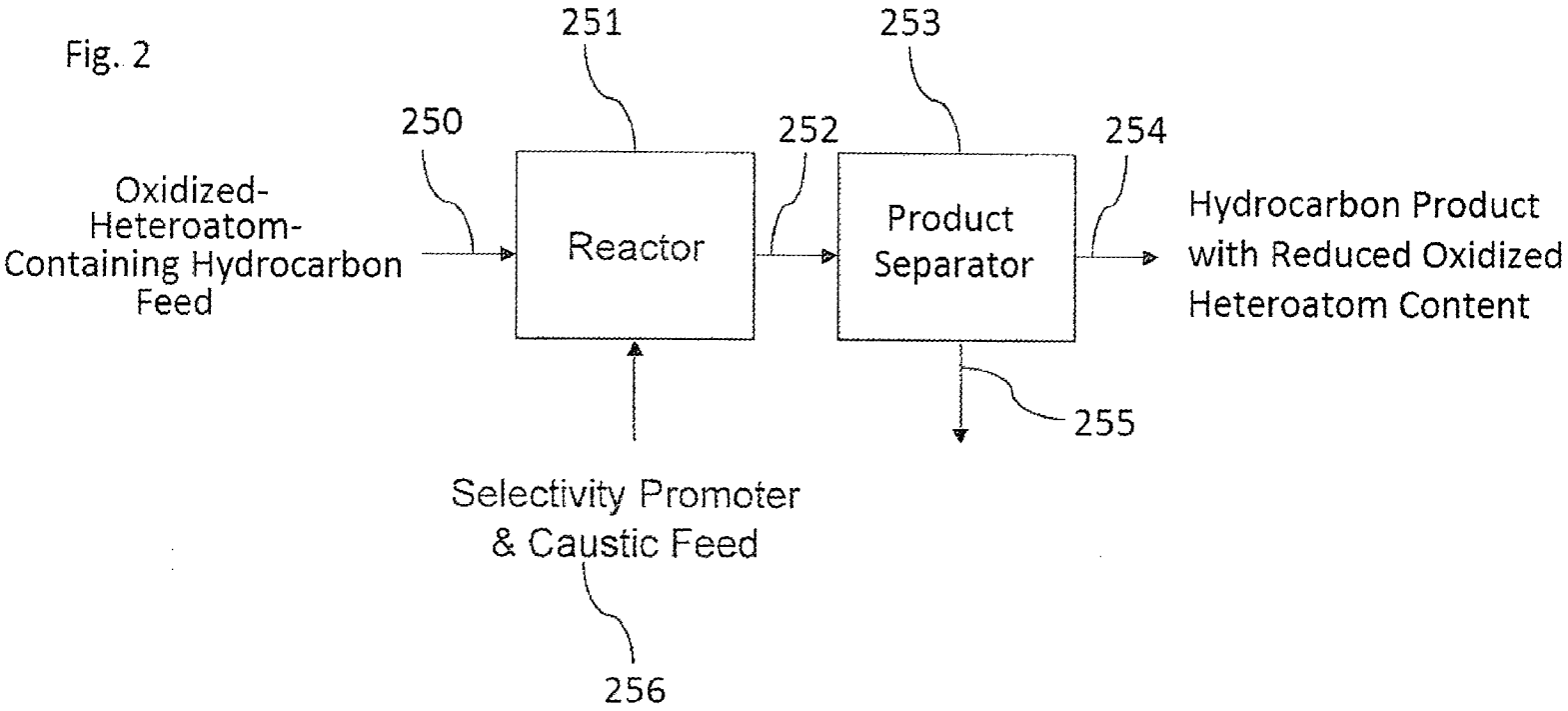
FIG. 2 is a generic process flow diagram of an embodiment of an oxidized heteroatom cleavage process, in accordance with embodiments of the present disclosure.

While this disclosure contains many specific details, it should be understood that various changes and modifications may be made without departing from the scope of the technology herein described. The scope of the technology shall in no way be construed as being limited to the number of constituting components, the concentration of constituting components, the materials thereof, the shapes thereof, the relative arrangement thereof, the temperature employed, the order of combination of constituents thereof, etc., and are disclosed simply as examples. The depictions and schemes shown herein are intended for illustrative purposes and shall in no way be construed as being limiting in the number of constituting components, connectivity, reaction steps, the materials thereof, the shapes thereof, the relative arrangement thereof, the order of reaction steps thereof, etc., and are disclosed simply as an aid for understanding. The examples described herein relate to the removal of oxidized heteroatoms from hydrocarbon streams including crude oil, refinery intermediate streams, and refinery products.

Unless otherwise indicated, all numbers expressing quantities of ingredients, properties such as molecular weight, reaction conditions, and so forth used in this specification and claims are to be understood as being modified in all instances by the term "about." Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements.

As used in this application, the term "promoted-caustic visbreaker" means a heated reactor that contains a caustic and a selectivity promoter that react with oxidized heteroatoms to remove sulfur, nickel, vanadium, iron and other heteroatoms, increase API gravity and decrease total acid number.

As used in this application, the term "contaminated hydrocarbon stream" is a mixture of hydrocarbons containing heteroatom constituents. "Heteroatoms" is intended to include all elements other than carbon and hydrogen.

As used in this application, the term "sulfoxidation" is a reaction or conversion, whether or not catalytic, that produces sulfoxide or organo-sulfoxide, sulfone or organo-sulfone, sulfonate or organo-sulfonate, or sulfonic acid or organo-sulfonic acid compounds (and/or mixtures thereof) from organosulfur compounds. A sulfone is a chemical compound containing a sulfonyl functional group attached to two carbon atoms. The central hexavalent sulfur atom is double bonded to each of two oxygen atoms and has a single bond to each of two carbon atoms, usually in two separate hydrocarbon substituents. The general structural formula is R—S(═O)$_2$—R' where R and R' are the organic groups which may be hydrogen or an organic compound (which may be further substituted) including, but not limited to, straight, branched and cyclic alkyl groups; straight, branched and cyclic alkenyl groups; and aromatic or polycyclic aromatic groups. Further substituents where R is an organic may include hydroxide groups, carbonyl groups, aldehyde groups, ether groups, carboxylic acid and carboxylate groups, phenol or phenolate groups, alkoxide groups, amine groups, imine groups, cyano groups, thiol or thiolate groups, thioether groups, disulfide groups, sulfate groups, and phosphate groups.

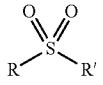

A sulfoxide is a chemical compound containing a sulfinyl (SO) functional group attached to two carbon atoms. It is a polar functional group. Sulfoxides are the oxidized derivatives sulfides. Sulfoxides are generally represented with the structural formula R—S(═O)—R', where R and R' are organic groups which may be hydrogen or an organic compound (which may be further substituted) including, but not limited to, straight, branched and cyclic alkyl groups; straight, branched and cyclic alkenyl groups; and aromatic or polycyclic aromatic groups. Further substituents where R is an organic may include hydroxide groups, carbonyl groups, aldehyde groups, ether groups, carboxylic acid and carboxylate groups, phenol or phenolate groups, alkoxide groups, amine groups, imine groups, cyano groups, thiol or thiolate groups, thioether groups, disulfide groups, sulfate groups, and phosphate groups. The bond between the sulfur and oxygen atoms is intermediate of a dative bond and a polarized double bond.

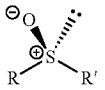

A sulfonate is a salt or ester of a sulfonic acid. It contains the functional group R—SO$_2$O—. The R groups may be any of the R groups described in reference to the sulfoxides above.

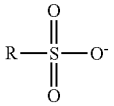

A sulfonic acid (or sulphonic acid) refers to a member of the class of organosulfur compounds with the general formula RS(═O)$_2$—OH, where R may be any of the R groups described in reference to the sulfoxides above and the S(═O)$_2$ —OH group a sulfonyl hydroxide.

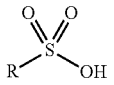

As used in this application, a reaction or conversion of nitrogen may also occur, whether or not catalytic, that produces an amine oxide, a nitroso compound, a nitrate, or a nitro compound. Amine oxide is also known as amine-N-oxide and N-oxide, is a chemical compound that contains the functional group R$_3$N$^-$—O$^-$, an N—O bond with three additional hydrogen and/or hydrocarbon side chains attached to N. The R groups may be organic groups which may be hydrogen or an organic compound (which may be further substituted) including, but not limited to, straight, branched and cyclic alkyl groups; straight, branched and cyclic alkenyl groups; and aromatic or polycyclic aromatic groups. Further substituents where R is an organic may include hydroxide groups, carbonyl groups, aldehyde groups, ether groups, carboxylic acid and carboxylate groups, phenol or phenolate groups, alkoxide groups, amine groups, imine groups, cyano groups, thiol or thiolate groups, thioether groups, disulfide groups, sulfate groups, and phosphate groups. The R groups may also be attached to each other by means of a chemical bond.

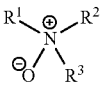

A nitroso compound is a chemical compound that contains the functional group R—N═O, an N═O bond with one additional hydrogen and/or hydrocarbon side chains attached to N. The R group may be any of the R groups described above in reference to amine oxide.

Nitrate is a polyatomic ion with the molecular formula $NO_3^-$. The R group may be any of the R groups described above in reference to amine oxide.

Nitro compounds are organic compounds that contain one or more nitro functional groups (—$NO_2$). The R group may be any of the R groups described above in reference to amine oxide.

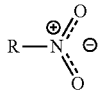

In one embodiment, the invention provides a method of upgrading an oxidized-heteroatom-containing hydrocarbon feed by removing oxidized heteroatom contaminants, the method comprising: contacting at least one of sulfone, sulfoxide, sulfonate, sulfonic acid and combinations thereof in the oxidized-heteroatom-containing hydrocarbon feed with at least one caustic and at least one selectivity promoter to form a first intermediate stream; and removing the oxidized-heteroatom contaminants from the first intermediate stream. The oxidized-heteroatom-containing hydrocarbon feed may include one or both of naturally occurring oxidized heteroatoms and artificially created oxidized heteroatoms.

In an alternative embodiment, the invention provides a method of upgrading an oxidized-heteroatom-containing hydrocarbon feed by removing oxidized-heteroatom contaminants, the method comprising: contacting at least one of sulfone, sulfoxide, sulfonate, sulfonic acid and combinations thereof in the oxidized-heteroatom-containing hydrocarbon feed with at least one caustic and at least one selectivity promoter to form a first intermediate stream; removing the oxidized-heteroatom contaminants from the first intermediate stream; and recovering the at least one caustic and at least one selectivity promoter for reuse. The oxidized-heteroatom-containing hydrocarbon feed may include one or both of naturally occurring oxidized heteroatoms and artificially created oxidized heteroatoms.

In another embodiment, the invention provides a method of upgrading an oxidized-heteroatom-containing hydrocarbon feed by removing oxidized heteroatom contaminants, the method comprising: extracting at least one of sulfone, sulfoxide, sulfonate, sulfonic acid and combinations thereof from the oxidized-heteroatom-containing hydrocarbon feed to form a first intermediate stream; contacting the first intermediate stream with at least one caustic and at least one selectivity promoter to form a second intermediate stream; and removing the oxidized-heteroatom contaminants from the second intermediate stream. The oxidized-heteroatom-containing hydrocarbon feed may include one or both of naturally occurring oxidized heteroatoms and artificially created oxidized heteroatoms. In another embodiment, the invention provides a method of upgrading a heteroatom-containing hydrocarbon feed by removing heteroatom contaminants, the method comprising: contacting the heteroatom-containing feed with an oxidant to oxidize at least a portion of the heteroatom contaminants to form a first intermediate stream; contacting the first intermediate stream with at least one caustic and at least one selectivity promoter to form a second intermediate stream; separating a substantially heteroatom-free hydrocarbon product from the second intermediate stream. The oxidant may be used in the presence of a catalyst.

In another embodiment, the invention provides a method of upgrading a heteroatom-containing hydrocarbon feed by removing heteroatom contaminants, the method comprising: contacting the heteroatom-containing hydrocarbon feed with an oxidant to oxidize at least a portion of the heteroatom contaminants to form a first intermediate stream; contacting the first intermediate stream with at least one caustic and at least one selectivity promoter to form a second intermediate stream; separating a substantially heteroatom-free hydrocarbon product from the second intermediate stream; recovering the at least one caustic and at least one selectivity promoter from the second intermediate stream; and recycling the recovered at least one caustic and at least one selectivity promoter.

In a further embodiment, the invention provides a method of upgrading a heteroatom-containing hydrocarbon feed by removing heteroatom contaminants, the method comprising oxidizing dibenzothiophenes to sulfones, reacting the sulfones with caustic and a selectivity promoter, and separating a substantially heteroatom-free hydrocarbon product for fuel.

Other features, aspects, and advantages of the present invention will become better understood with reference to the following description.

The oxidation reaction may be carried out at a temperature of about 20° C. to about 120° C., at a pressure of about 0.5 atmospheres to about 10 atmospheres, with a contact time of about 2 minutes to about 180 minutes. The oxidant employed may be any oxidant which, optionally in the presence of a catalyst, oxidizes heteroatoms in the heteroatom-containing hydrocarbon feed, for example, but not limited to, hydrogen peroxide, peracetic acid, benzyl hydroperoxide, ethylbenzene hydroperoxide, cumyl hydroperoxide, sodium hypochlorite, oxygen, air, etc, and more presently preferably an oxidant which does not oxidize the heteroatom-free hydrocarbons in the contaminated hydrocarbon feed. Even more preferably, the catalyst employed therein may be any catalyst capable of utilizing an oxidant to oxidize heteroatoms in the heteroatom-containing hydrocarbon feed Suitable catalysts include, but are not limited to, catalyst compositions represented by the formula $M_mO_m(OR)_n$, where M is a metal complex, such as, for example, titanium or any metal, including, but not limited to, rhenium, tungsten or other transition metals alone or in combination that causes the chemical conversion of the sulfur species, as described herein. R is carbon group having at least 3 carbon atoms, where at each occurrence R may individually be a substituted alkyl group containing at least one OH group, a substituted cycloalkyl group containing at least one OH group, a substituted cycloalkylalkyl group containing at least one OH group, a substituted heterocyclyl group containing at least one OH group, or a heterocyclylalkyl containing at least one OH group. The subscripts m and n may each independently be integers between about 1 and about 8. R may be substituted with halogens such as F, Cl, Br, and I. In some embodiments, the metal alkoxide comprises bis(glycerol)oxotitanium(IV)), where M is Ti, m is 1, n is 2, and R is a glycerol group. Other examples of metal alkoxides include bis(ethyleneglycol)oxotitanium (IV), bis(erythritol)oxotitanium (IV), and bis(sorbitol)oxotitanium (IV), as disclosed in International Publication Number WO 2009/120238 A1, to Litz et al.

Other suitable catalysts include, but are not limited to, catalyst compositions prepared by the reaction of Q-R-Q' with a bis(polyol)oxotitanium(IV) catalyst, wherein Q and Q' each independently comprise an isocyanate, anhydride, sulfonyl halide, benzyl halide, carboxylic acid halide, phosphoryl acid halide, silyl chloride, or any chemical functionality capable of reacting with the —OH pendant group of the catalyst, and wherein R comprises a linking group. The R linking group is selected from the group consisting of alkyl groups (including linear, branched, saturated, unsaturated, cyclic, and substituted alkyl groups, and wherein hetero atoms, such as oxygen, nitrogen, sulfur, silicon, phosphorus, and the like can be present in the alkyl group), typically with from 1 to about 22 carbon atoms, preferably with from 1 to about 12 carbon atoms, and more preferably with from 1 to about 7 carbon atoms, although the number of carbon atoms can be outside of these ranges, aryl groups (including substituted aryl groups), typically with from about 6 to about 30 carbon atoms, preferably with from about 6 to about 15 carbon atoms, and more preferably with from about 6 to about 12 carbon atoms, although the number of carbon atoms can be outside of these ranges, arylalkyl groups (including substituted arylalkyl groups), typically with from about 7 to about 30 carbon atoms, preferably with from about 7 to about 15 carbon atoms, and more preferably with from about 7 to about 12 carbon atoms, although the number of carbon atoms can be outside of these ranges, such as benzyl or the like, alkylaryl groups (including substituted alkylaryl groups), typically with from about 7 to about 30 carbon atoms, preferably with from about 7 to about 15 carbon atoms, and more preferably with from about 7 to about 12 carbon atoms, although the number of carbon atoms can be outside of these ranges, silicon or phosphorus, typically with from 1 to about 22 carbon atoms, preferably with from 1 to about 12 carbon atoms, and more preferably with from 1 to about 7 carbon atoms, although the number of carbon atoms can be outside of these ranges, polyalkyleneoxy groups (including substituted polyalkyleneoxy groups), such as polyethyleneoxy groups, polypropyleneoxy groups, polybutyleneoxy groups, and the like, typically with from about 3 to about 60 repeat alkyleneoxy units, preferably with from about 3 to about 30 repeat alkyleneoxy units, and more preferably with from about 3 to about 20 repeat alkyleneoxy units, although the number of repeat alkyleneoxy units can be outside of these ranges, as disclosed in International Publication Number WO 2009/120238 A1, to Litz et al.

The solvent used in extracting the oxidized heteroatoms from the oxidized heteroatom-containing hydrocarbon stream (e.g. in a liquid-liquid extractor) may be any solvent with relatively low solubility in oil but relatively high solubility of oxidized heteroatom-containing hydrocarbons, including, but not limited to, acetone, methanol, ethanol, ethyl lactate, N-methylpyrollidone, dimethylacetamide, dimethylformamide, gamma-butyrolactone, dimethyl sulfoxide, propylene carbonate, acetonitrile, acetic acid, sulfuric acid, liquid sulfur dioxide, etc, which is capable of extracting the oxidized heteroatoms from the heteroatom containing hydrocarbon stream and producing a substantially oxidized-heteroatom-free hydrocarbon product The caustic of the present invention may be any compound which exhibits basic properties including, but not limited to, metal hydroxides and sulfides, such as alkali metal hydroxides and sulfides, including, but not limited to, LiOH, NaOH, KOH and $Na_2S$; alkali earth metal hydroxides, such as $Ca(OH)_2$, $Mg(OH)_2$ and Ba(OH); carbonate salts, such as alkali metal carbonates, including, but not limited to, $Na_2CO_3$ and $K_2CO_3$; alkali earth metal carbonates, such as $CaCO_3$, $MgCO_3$ and $BaCO_3$; phosphate salts, including, but not limited to, alkali metal phosphates, such as sodium pyrophosphate, potassium pyrophosphate, sodium tripolyphosphate and potassium tripolyphosphate; and alkali earth metal phosphates, such as calcium pyrophosphate, magnesium pyrophosphate, barium pyrophosphate, calcium tripolyphosphate, magnesium tripolyphosphate and barium tripolyphosphate; silicate salts, such as, alkali metal silicates, such as sodium silicate and potassium silicate, and alkali earth metal silicates, such as calcium silicate, magnesium silicate and barium silicate, organic alkali compounds expressed by the general formula: $R\text{-}E^n\ M^mQ^{m-1}$, where R is hydrogen or an organic compound (which may be further substituted) including, but not limited to, straight, branched and cyclic alkyl groups; straight, branched and cyclic alkenyl groups; and aromatic or polycyclic aromatic groups. Further substituents where R is an organic may include hydroxide groups, carbonyl groups, aldehyde groups, ether groups, carboxylic acid and carboxylate groups, phenol or phenolate groups, alkoxide groups, amine groups, imine groups, cyano groups, thiol or thiolate groups, thioether groups, disulfide groups, sulfate groups, and phosphate groups. $E^{n-}$ represents an atom with a negative charge (where n=−1, −2, −3, −4 etc.) such as oxygen, sulfur, selenium, tellurium, nitrogen, phosphorus, and carbon; and $M^m$ is any cation (m=+1, +2, +3, +4 etc.), such as a metal ion, including, but not limited to, alkali metals, such as Li, Na, and K, alkali earth metals, such as Mg and Ca, and transition metals, such as Zn, and Cu. When m>+1, Q may be the same as $E^n$-R or an atom with a negative charge such as Br—, Cl—, I, or an anionic group that supports the charge balance of the cation $M^m$, including but not limited to, hydroxide, cyanide, cyanate, and carboxylates.

Examples of the straight or branched alkyl groups may include methyl, ethyl, n-, i-, sec- and t-butyl, octyl, 2-ethylhexyl and octadecyl. Examples of the straight or branched alkenyl groups may include vinyl, propenyl, allyl and butenyl. Examples of the cyclic alkyl and cyclic alkenyl groups may include cyclohexyl, cyclopentyl, and cyclohexene. Examples of the aromatic or polycyclic aromatic groups may include aryl groups, such as phenyl, naphthyl, andanthracenyl; aralkyl groups, such as benzyl and phenethyl; alkylaryl groups, such as methylphenyl, ethylphenyl, nonylphenyl, methylnaphthyl and ethylnaphthyl.

Preferred caustic compounds, based on reaction conversion and selectivity, are alkali metal hydroxides and sulfides, such as NaOH, KOH, $Na_2S$, and/or mixtures thereof.

In one embodiment of the present invention, the caustic may be in the molten phase. Presently preferred molten phase caustics include, but are not limited to, eutectic mixtures of the inorganic hydroxides with melting points less than 350° C., such as, for example, a 51 mole % NaOH/49 mole % KOH eutectic mixture which melts at about 170° C.

In another embodiment of the present invention, the caustic may be supported on an inorganic support, including, but not limited to, oxides, inert or active, such as, for example, a porous support, such as talc or inorganic oxides.

Suitable inorganic oxides include, but are not limited to, oxides of elements of groups IB, II-A and II-B, III-A and II-B, IV-A and IV-B, V-A and V-B, VI-B, of the Periodic Table of the Elements. Examples of oxides preferred as supports include copper oxides, silicon dioxide, aluminum oxide, and/or mixed oxides of copper, silicon and aluminum. Other suitable inorganic oxides which may be used alone or in combination with the abovementioned preferred oxide supports may be, for example, MgO, $ZrO_2$, $TiO_2$, CaO and/or mixtures thereof.

The support materials used may have a specific surface area in the range from 10 to 1000 $m^2/g$, a pore volume in the range from 0.1 to 5 ml/g and a mean particle size of from 0.1 to 10 cm. Preference may be given to supports having a specific surface area in the range from 0.5 to 500 $m^2/g$, a pore volume in the range from 0.5 to 3.5 ml/g and a mean particle size in the range from 0.5 to 3 cm. Particular preference may be given to supports having a specific surface area in the range from 200 to 400 $m^2/g$, and a pore volume in the range from 0.8 to 3.0 ml/g.

The selectivity promoter of the present invention may be any organic compound having at least one acidic proton.

Generally, the selectivity promoter has a pKa value (as measured in DMSO) in the range of from about 9 to about 32, preferably in the range of from about 18 to about 32. Examples of the selectivity promoter include, but are not limited to, hydroxyl-functional organic compounds; straight, branched, or cyclic amines having at least one H substituent; and/or mixtures thereof. The selectivity promoter may further include crown ethers.

Suitable hydroxyl-functional organic compounds include, but are not limited to: (i) straight-, branched-, or cyclic-alkyl alcohols (which may be further substituted) such as methanol, ethanol, isopropanol, ethylhexanol, cyclohexanol, ethanolamine, di-, and triethanolamine, mono- and di-methylaminoethanol; including -diols such as ethylene glycol, propylene glycol, 1,3-propanediol, and 1,2-cyclohexanediol; and -polyols, such as glycerol, erythritol, xylitol, sorbitol, etc; -monosaccharides, such as glucose, fructose, galactose, etc; -disaccharides, such as sucrose, lactose, and maltose; -polysaccharides, such as starch, cellulose, glycogen, chitan, wood chips and shavings; (ii) straight-, branched-, or cyclic-alkenyl alcohols (which may be further substituted), such as vinyl alcohol, and allyl alcohol; (iii)aryl- and aralkyl-alcohols (which may be further substituted), such as phenol, and benzyl alcohol; (iv) polycyclic aryl- and aralkyl-alcohols (which may be further substituted), such as naphthol, and α-tetralol; and (v) ammonium salts, such as choline hydroxide, and benzyltrimethylammonium hydroxide.

Examples of straight or branched alkyls may include: methyl, ethyl, n-, i-, sec- and t-butyl, octyl, 2-ethylhexyl and octadecyl. Examples of the straight or branched alkenyls may include: vinyl, propenyl, allyl and butenyl. Examples of the cyclic-alkyls may include: cyclohexyl, and cyclopentyl. Examples of aryls, aralkyls and polycyclics include: aryls, such as phenyl, naphthyl, anthracenyl; aralkyls, such as benzyl and phenethyl; alkylaryl, such as methylphenyl, ethylphenyl, nonylphenyl, methylnaphthyl and ethylnaphthyl.

Suitable amines, include, but are not limited to, straight-, branched-, and cyclic-amines having at least one H substituent, which may be further substituted, including, but not limited to, mono-, or di-substituted amines, such as methylamine, ethylamine, 2-ethylhexylamine, piperazine, 1,2-diaminoethane and/or mixtures thereof.

Suitable crown ethers, which may be further substituted, include, but are not limited to, 18-crown-6, 15-crown-5, etc; and/or mixtures thereof.

Preferred selectivity promoters, based on reaction conversion and selectivity, are ethylene glycol, propylene glycol, triethanolamine, and/or mixtures thereof.

The selectivity promoter is believed to decrease the likelihood of oxygenated byproduct formation as a result of the oxidized heteroatom removal.

In one embodiment of the present invention the at least one caustic and the at least one selectivity promoter may be different components. In another embodiment of the present invention the at least one caustic and the at least one selectivity promoter may be the same component. When the at least one caustic and the at least one selectivity promoter are the same component they may be referred to as a caustic selectivity promoter. Moreover, a suitable caustic selectivity promoter may possess the properties of both the at least one caustic and the at least one selectivity promoter. That is, combinations of caustics with selectivity promoters may react (in situ or a priori) to form a caustic selectivity promoter which has the properties of both a caustic and a selectivity promoter.

The caustic selectivity promoter may react with the oxidized heteroatom-containing compounds, such as dibenzothiophene sulfoxides, dibenzothiophene sulfones, and/or mixtures thereof, to produce substantially non-oxygenated hydrocarbon products, such as biphenyls. Non-limiting examples of caustic selectivity promoters include, but are not limited to, sodium ascorbate, sodium erythorbate, sodium gluconate, 4-hydroxyphenyl glycol, sodium salts of starch or cellulose, potassium salts of starch or cellulose, sodium salts of chitan or chitosan, potassium salts of chitan or chitosan, sodium glycolate, glyceraldehyde sodium salt, 1-thio-beta-D-glucose sodium salt, and/or mixtures thereof.

For example, the caustic, such as sodium hydroxide and/or potassium hydroxide and the selectivity promoter, such as ethylene glycol, may react in situ or prior to contacting with the oxidized heteroatom-containing hydrocarbon feed, to form water and a caustic selectivity promoter, such as the sodium or potassium salt of ethylene glycol. Generally, an excess molar ratio of selectivity promoter hydroxyl groups to caustic cations is preferred for conversion and selectivity. The step of contacting may be any process that leads to transformation of the reactants or reagents from one set of chemical substance to another at various temperatures, reaction rates and chemical concentrations.

The promoted-caustic visbreaker reaction may take place at a temperature in the range of from about 150° C. to about 350° C., at a pressure in the range of from about 0 psig to about 2000 psig, with a contact time in the range of from about 2 minutes to about 180 minutes. Without being limited to any particular theory, the reaction mechanism is believed to include a solvolysis reaction; particularly alcoholysis when the selectivity promoter is an alcohol, and aminolysis when the selectivity promoter is an amine; without the selectivity promoter of the present invention, the reaction mechanism may involve hydrolysis which leads to the undesirable formation of substantially oxygenated product.

Generally, the mole ratio of caustic to selectivity promoter is in the range of from about 10:1 to about 1:10, preferably the mole ratio of caustic to selectivity promoter is in the range of from about 3:1 to about 1:3, and more preferably the mole ratio of caustic to selectivity promoter is in the range of from about 2:1 to about 1:2.

Generally, the mole ratio of caustic and selectivity promoter to oxidized heteroatom in the heteroatom-containing hydrocarbon feed oil is in the range of from about 100:1 to about 1:1, preferably the mole ratio of caustic and selectivity promoter to oxidized heteroatom in the heteroatom-containing hydrocarbon feed oil is in the range of from about 10:1 to about 1:1, and more preferably the mole ratio of caustic and selectivity promoter to oxidized heteroatom in the heteroatom-containing hydrocarbon feed oil is in the range of from about 3:1 to about 1:1. Separation of the heavy caustic phase from the light oil phase may be by gravity. Other suitable methods include, but are not limited to, solvent extraction of the caustic or oil phases, such as by washing with water, centrifugation, distillation, vortex separation, and membrane separation and combinations thereof. Trace quantities of caustic and selectivity promoter may be removed according to known methods by those skilled in the art.

As a result of removing the oxidized heteroatom contaminants from the oxidized heteroatom-containing hydrocarbon feed and producing few oxygenated by-products, the light oil phase product has a lower density and viscosity than the untreated, contaminated feed. The heavy caustic phase density is generally in the range of from about 1.0 to about 3.0 g/mL and the light product oil phase density is generally in the range of from about 0.7 to about 1.1 g/mL.

Without the selectivity promoter the treated stream contains substantial oxygenated by-products. Generally, the method of the present invention produces less than about 70% oxygenated by-products, preferably less than about 40% oxygenated by-products, and more preferably less than about 20% oxygenated by-products in the treated stream. This beneficial effect is more clearly demonstrated in the non-limiting examples below.

In the above embodiments, a number of oxidized heteroatom byproducts have been observed as a result of the oxidized heteroatom cleavage process. For example, the cleavage of oxidized sulfur from oxidized-heteroatom-containing hydrocarbons has been observed to result in the formation of a number of oxidized heteroatom byproducts including, for example, sulfite and sulfate.

As illustrated in FIG. 2, an oxidized-heteroatom-containing hydrocarbon feed 250 is reacted with a caustic (e.g., sodium hydroxide, potassium hydroxide, eutectic mixtures thereof etc.) and a selectivity promoter 256 in reactor 251 to produce a biphasic first intermediate stream 252. First intermediate stream 252 is transferred to product separator 253 where oxidized heteroatom byproducts 255 are removed. A hydrocarbon product with reduced oxidized heteroatom content 254 is obtained.

Figure 3:
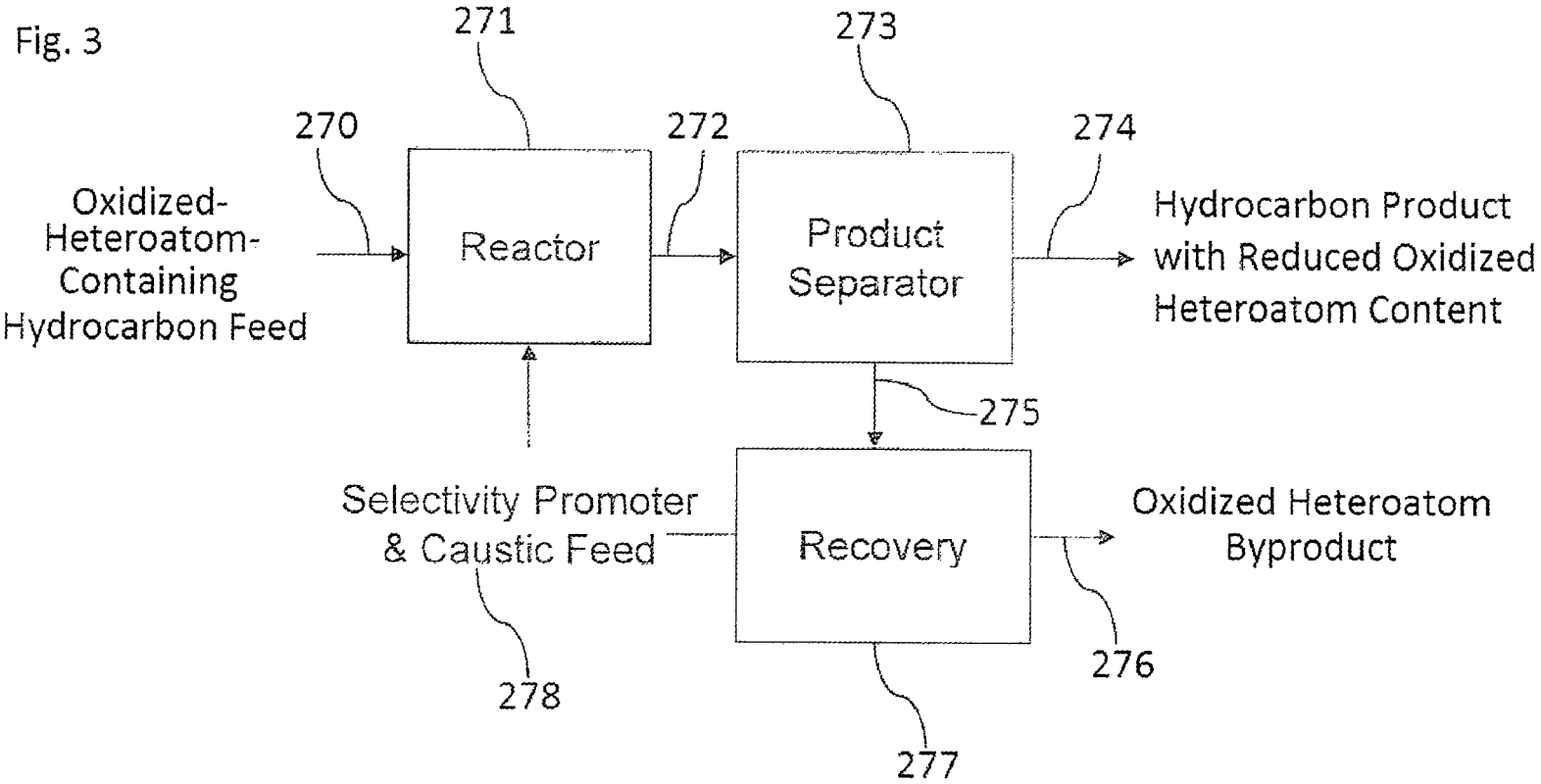
FIG. 3 is a more detailed process flow diagram of an embodiment of an oxidized heteroatom cleavage process followed by recovery of caustic and selectivity promoter byproduct, in accordance with embodiments of the present disclosure.

As illustrated in FIG. 3, an oxidized-heteroatom-containing hydrocarbon feed 270 is reacted with a caustic and a selectivity promoter 278 in reactor 271 to produce a biphasic first intermediate stream 272. First intermediate stream 272 is then sent to a product separator 273 where caustic, selectivity promoter and oxidized heteroatom byproduct 275 are removed from the hydrocarbon stream. Optionally, oxidized heteroatom byproduct 276 may be subsequently removed from the caustic and selectivity promoter 278 in recovery vessel 277, allowing for reuse of the caustic and selectivity promoter. A hydrocarbon product with reduced oxidized heteroatom content 274 is obtained.

Figure 4:
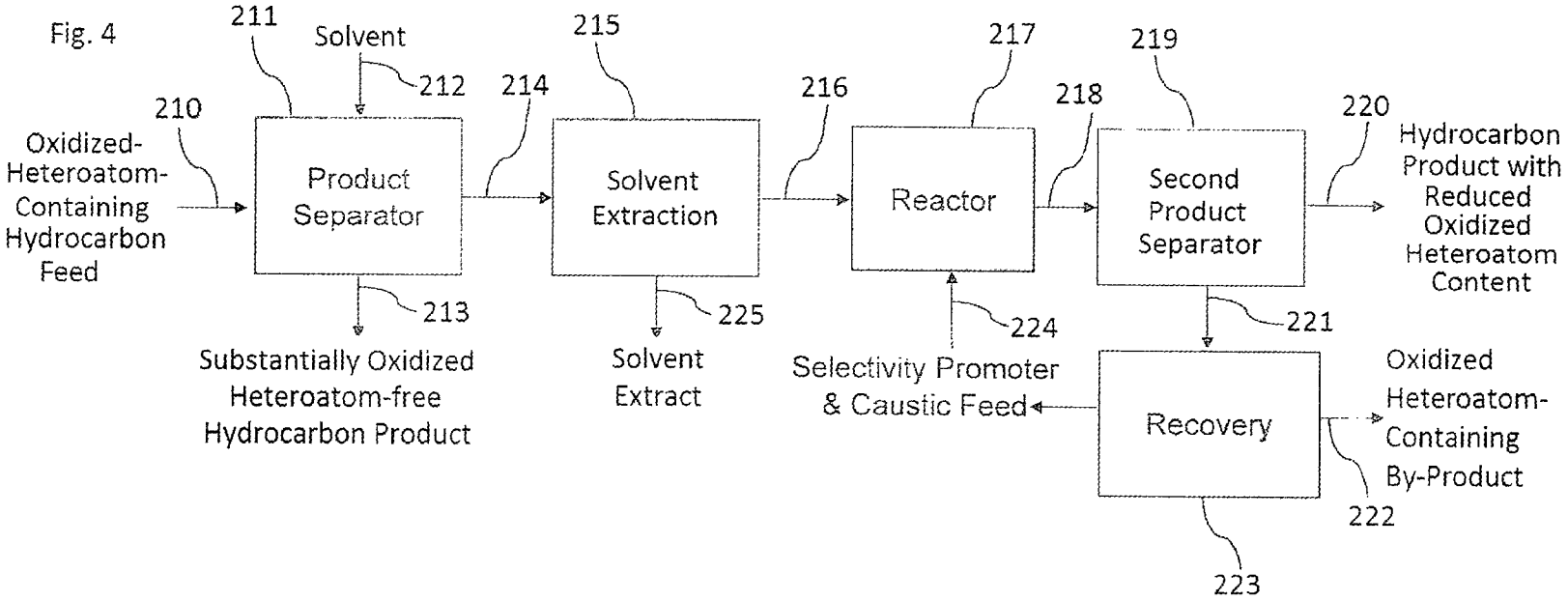
FIG. 4 is an alternative detailed process flow diagram of an embodiment of a combination oxidized-heteroatom-containing hydrocarbon extraction followed by oxidized heteroatom cleavage, in accordance with embodiments of the present invention.

As illustrated in FIG. 4, an oxidized-heteroatom-containing hydrocarbon feed 210 is contacted with a solvent 212 in product separator 211 to produce first intermediate stream 214 and substantially oxidized heteroatom-free hydrocarbon product stream 213. First intermediate stream 214 comprises an oxidized-heteroatom-contaminated hydrocarbon stream with an increased oxidized-heteroatom concentration. First intermediate stream 214 is then sent to solvent extraction vessel 215 where solvent extract 225 is removed to produce second intermediate stream 216.

Second intermediate stream 216 may be reacted with caustic and selectivity promoter 224 in reactor vessel 217 to produce a biphasic third intermediate stream 218. Third intermediate stream 218 is transferred to second product separator 219 from which a hydrocarbon product with reduced oxidized heteroatom content 220 is obtained. The denser phase 221 containing the selectivity promoter and caustic and oxidized heteroatom byproducts may be transferred to a recovery vessel 223 in which the selectivity promoter and caustic 224 may be recovered to reactor 217 and the oxidized heteroatom-containing byproduct 222 may be sent to a recovery area for further processing, as would be understood by those skilled in the art.

Figure 5:
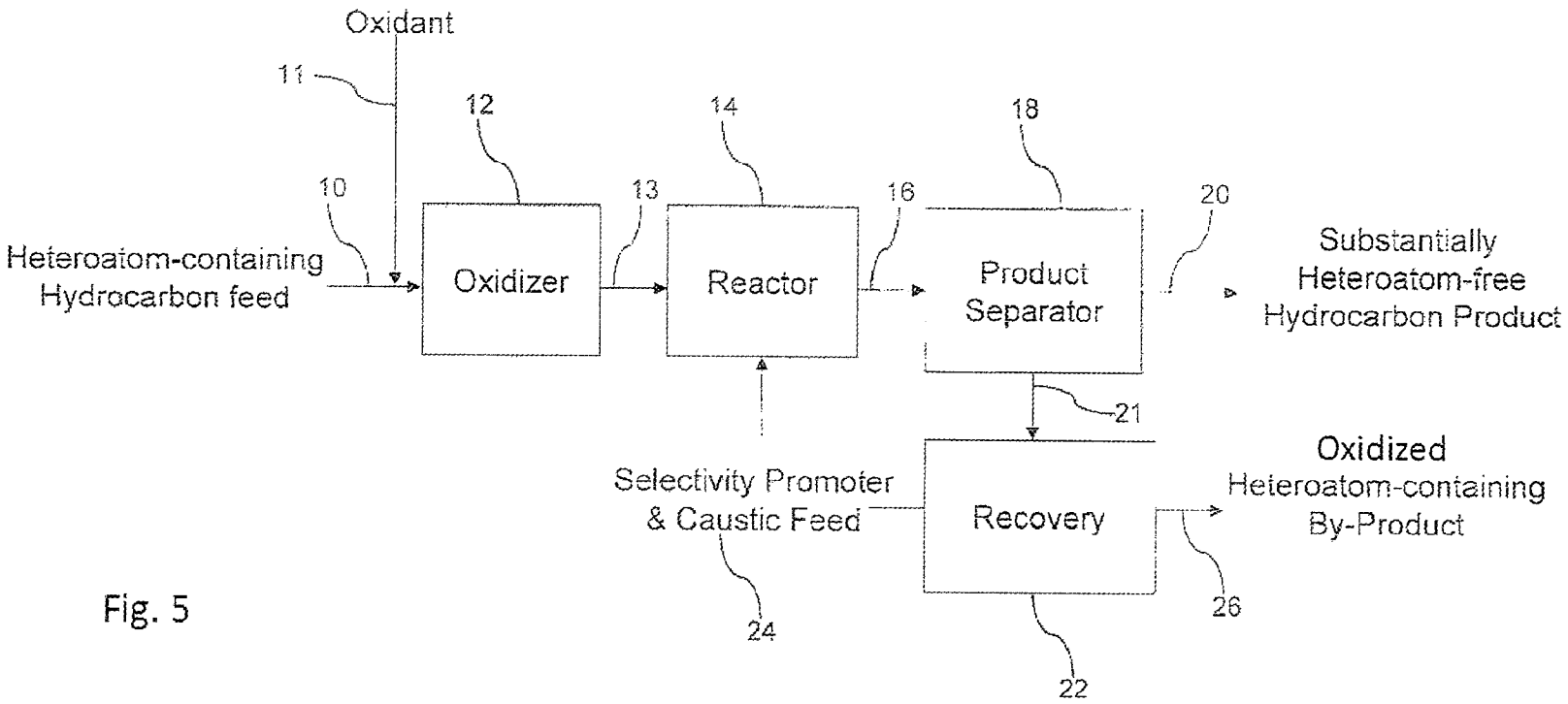
FIG. 5 is a generic process flow diagram of an embodiment of a combination heteroatom oxidation process followed by oxidized heteroatom cleavage, in accordance with embodiments of the present disclosure.

As illustrated in FIG. 5, a heteroatom-containing hydrocarbon feed 10 may be combined with an oxidant 11 and subjected to an oxidizing process in an oxidizer vessel 12 in order to meet current and future environmental standards. The oxidizer vessel 12 may optionally contain a catalyst or promoter (not shown).

After subjecting a hydrocarbon stream to oxidation conditions in oxidizer vessel 12, thereby oxidizing at least a portion of the heteroatom compounds (e.g., oxidizing dibenzothiophenes to sulfones), a first intermediate stream 13 may be generated. The first intermediate stream 13 may be reacted with caustic (e.g., sodium hydroxide, potassium hydroxide, eutectic mixtures thereof etc.) and a selectivity promoter 24 to produce a biphasic second intermediate stream 16.

Second intermediate stream 16 may be transferred to a product separator 18 from which a substantially heteroatom-free hydrocarbon product 20 may be recovered from the light phase. The denser phase 21 containing the selectivity promoter and caustic and oxidized heteroatom by-products may be transferred to a recovery vessel 22 in which the selectivity promoter and caustic 24 may be recovered and recycled to reactor 14 and the oxidized heteroatom-containing byproduct 26 may be sent to a recovery area for further processing, as would be understood by those skilled in the art.

Figure 6A:
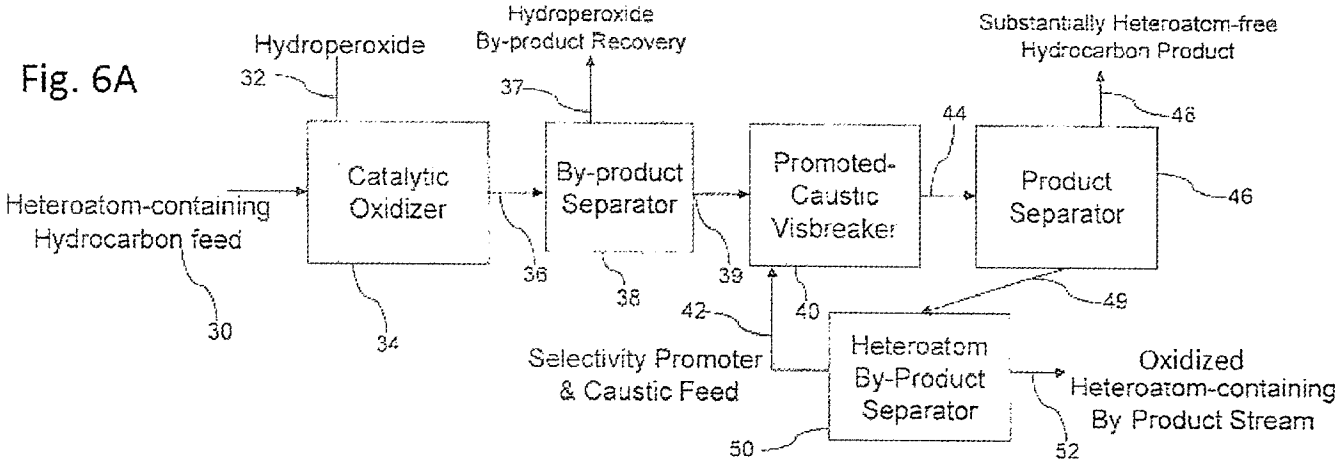
FIG. 6A is a more detailed process flow diagram of an embodiment of a combination heteroatom oxidation process followed by oxidized heteroatom cleavage, in accordance with embodiments of the present disclosure.

In a more specific embodiment, as illustrated in FIG. 6A, a heteroatom-containing hydrocarbon feed 30 may be combined with a hydroperoxide 32 in a catalytic oxidizer 34 thereby oxidizing the heteroatoms yielding a first intermediate stream 36. First intermediate stream 36 may be fed to a by-product separator 38 from which the hydroperoxide by-product may be recovered and recycled for reuse in catalytic oxidizer 34 (as would be understood by those skilled in the art) yielding a second intermediate stream 39. The second intermediate stream 39 may be reacted with a selectivity promoter and caustic feed 42 in promoted-caustic visbreaker 40 producing a third intermediate biphasic stream 44 that may be separated in product separator 46 to produce a substantially heteroatom-free hydrocarbon product 48 from the light phase. The dense phase 49 from product separator 46 may be transferred to heteroatom by-product separator 50 from which a oxidized heteroatom-containing byproduct stream 52 and selectivity promoter and caustic feed 42 may be independently recovered, as would be known by those skilled in the art.

Figure 6B:
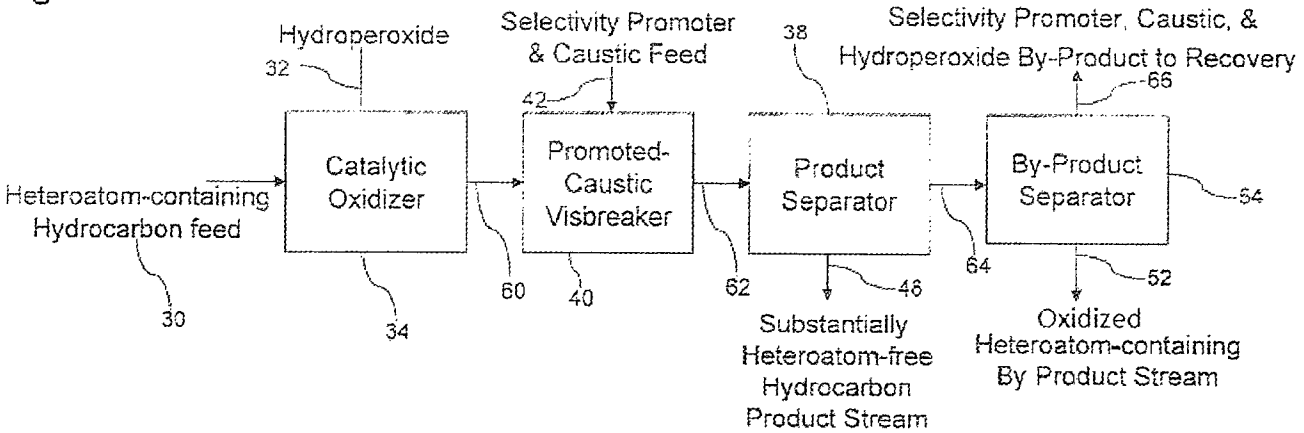
FIG. 6B is an alternative more detailed process flow diagram of an embodiment of a combination heteroatom oxidation process followed by oxidized heteroatom cleavage, in accordance with embodiments of the present disclosure.

In still another embodiment, as illustrated in FIG. 6B, the heteroatom-containing hydrocarbon feed 30 may be combined with hydroperoxide 32 and contacted with a catalyst in catalytic oxidizer 34 yielding first intermediate stream 60 which may be transferred to a promoted-caustic visbreaker 40 where it reacts with selectivity promoter and caustic feed 42 producing a biphasic second intermediate stream 62. Second intermediate stream 62 may be transferred to a product separator 38 from which a substantially heteroatom-free hydrocarbon product stream 48 may be removed as the light phase and transported to storage or commercial use. The byproduct separator 54 may separate the dense phase 64 into two streams: an oxidizied heteroatom-containing by-product stream 52 (which may be transported to storage or commercial use) and a by-product mixture stream 66 containing the selectivity promoter, caustic, and hydroperoxide by-products for recovery and recycle, as would be known by those skilled in the art.

Figure 7:
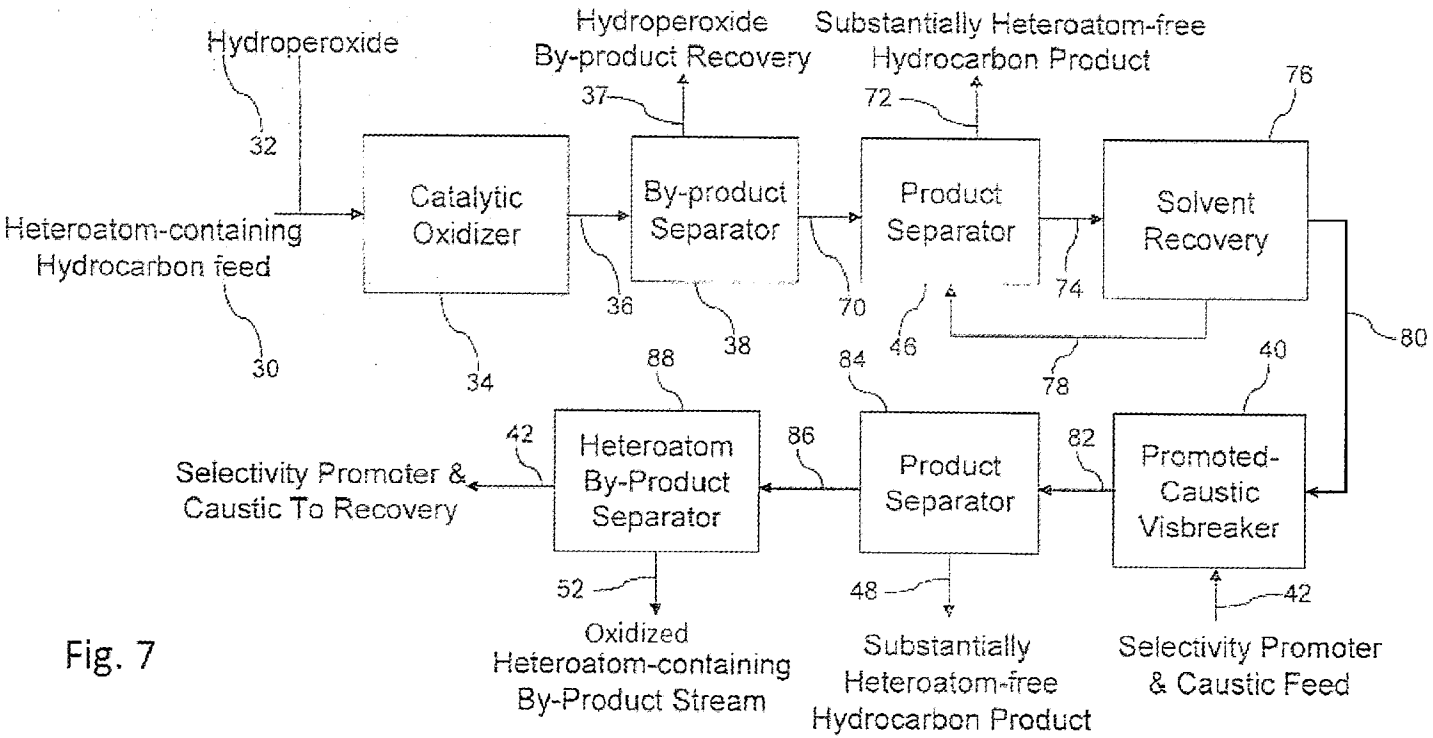
FIG. 7 is an even more detailed process flow diagram of an embodiment of a combination heteroatom oxidation process followed by oxidized heteroatom cleavage, in accordance with embodiments of the present disclosure.

In yet another embodiment, as illustrated in FIG. 7, the heteroatom-containing hydrocarbon feed 30 may be mixed with a hydroperoxide feed 32 and may be reacted with a catalyst or promoter (not shown) in the catalytic oxidizer 34 producing a first intermediate stream 36. Stream 36 may be transferred to a by-product separator 38 from which the hydroperoxide by-product 37 may be separated producing a second intermediate stream 70. Stream 70 may be extracted by solvent 78 in product separator 46 (e.g. a liquid-liquid extraction column) from which a substantially heteroatom-free hydrocarbon product 72 may be withdrawn resulting in a third intermediate stream 74. Stream 74 may be fed to solvent recovery 76 from which solvent 78 may be recovered and recycled to product separator 46, producing a fourth intermediate stream 80. Stream 80 may be treated in the promoted-caustic visbreaker 40 containing selectivity promoter and caustic feed 42 producing a biphasic fifth intermediate stream 82. The two phases of stream 82 may be separated in product separator 84 as a light phase 48 and a dense phase 86. The light phase 48 may comprise a substantially heteroatom-free hydrocarbon product that may be shipped to storage or commercial use. The dense phase 86 may be transferred to a heteroatom by-product separator 88 from which an oxidized heteroatom-containing byproduct stream 52 may be separated from resulting in a stream 42 containing a selectivity promoter and caustic that may be recovered and recycled for reuse in the promoted-caustic visbreaker 40, as would be understood by those skilled in the art.

Figure 8:
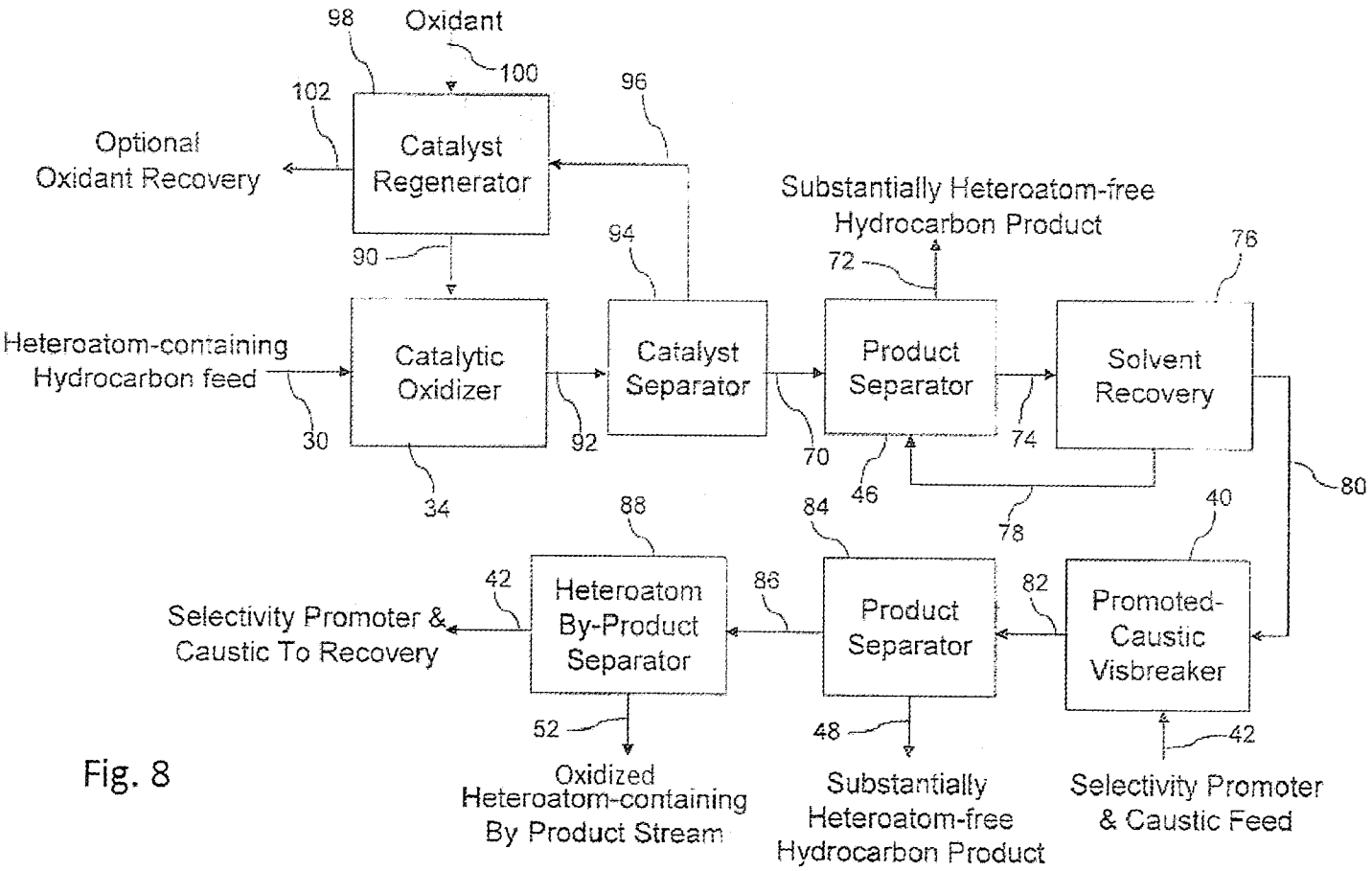
FIG. 8 is an alternative even more detailed process flow diagram of an embodiment of a combination heteroatom oxidation process followed by oxidized heteroatom cleavage, in accordance with embodiments of the present disclosure.

In still another embodiment, as illustrated in FIG. 8, the heteroatom-containing hydrocarbon feed 30 may be fed to a catalytic oxidizer 34 where it may be reacted with catalyst stream 90 in the catalytic oxidizer 34 producing a first intermediate stream 92. Stream 92 may be transferred to catalyst separator 94 from which a second intermediate stream 70 and a depleted catalyst stream 96 may be separated. Stream 96 may be fed to catalyst regenerator 98 for regeneration by oxidant feed 100 producing catalyst stream 90 and an oxidant by-product stream 102. Oxidant by-product stream 102 may be optionally recovered, recycled, and reused as would be understood by those skilled in the art. Stream 70 may be extracted by solvent 78 in product separator 46 (e.g. a liquid-liquid extraction column) from which a substantially heteroatom-free hydrocarbon product 72 may be withdrawn resulting in a third intermediate stream 74. Stream 74 may be fed to solvent recovery 76 from which solvent 78 may be recovered and recycled to product separator 46, producing a fourth intermediate stream 80. Stream 80 may be treated in the promoted-caustic visbreaker 40 containing selectivity promoter and caustic feed 42 producing a biphasic fifth intermediate stream 82. The two phases of stream 82 may be separated in product separator 84 as a light phase 48 and a dense phase 86. The light phase 48 may comprise a substantially heteroatom-free hydrocarbon product that may be shipped to storage or commercial use. The dense phase 86 may be transferred to a heteroatom by-product separator 88 from which an oxidized heteroatom-containing byproduct stream 52 may be separated from resulting in a stream 42 containing a selectivity promoter and caustic that may be recovered and recycled for reuse in the promoted-caustic visbreaker 40, as would be understood by those skilled in the art.

Figure 9:
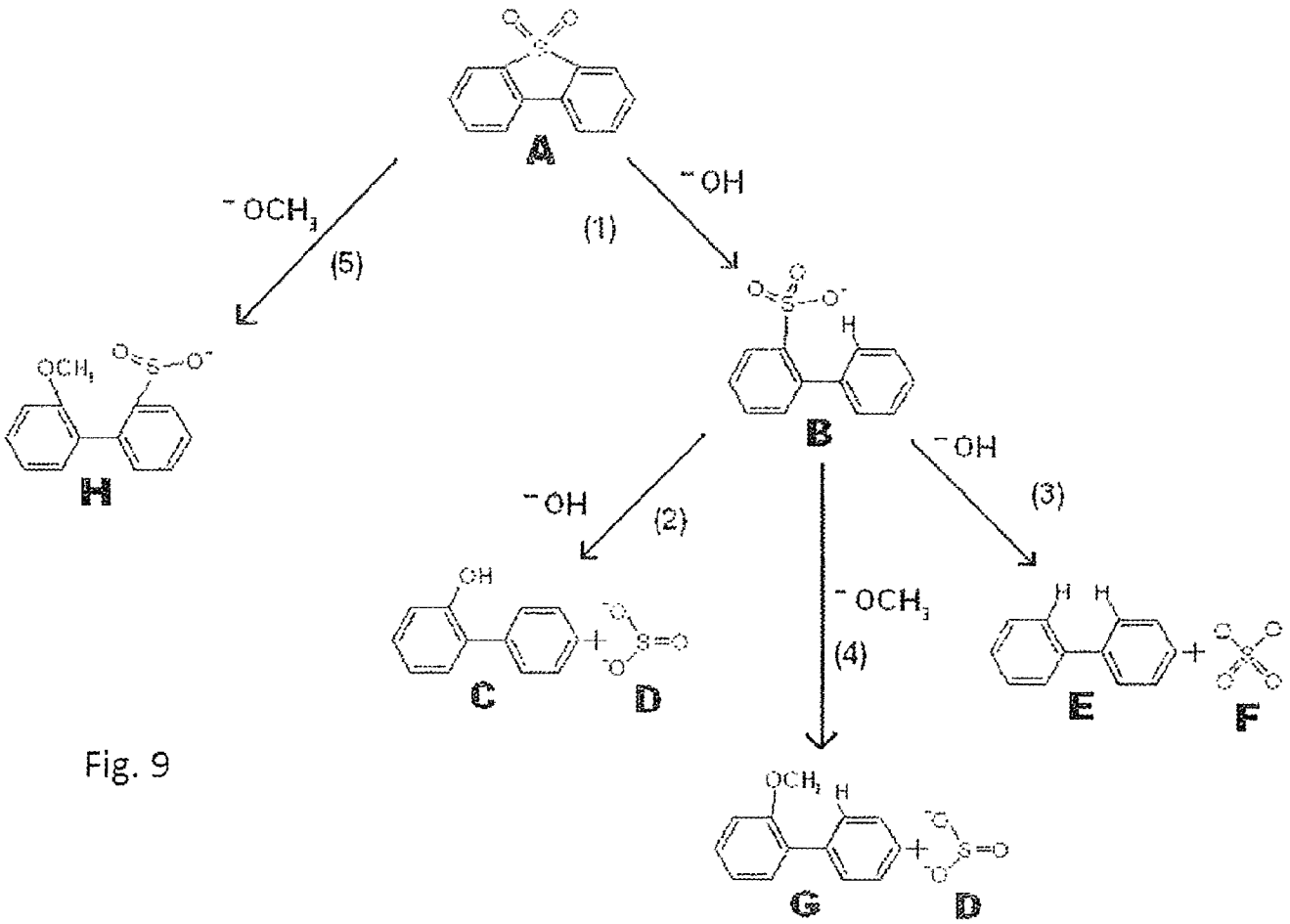
FIG. 9 illustrates various decomposition modes for dibenzothiophene sulfone.

FIG. 9 illustrates how the selectively of the reaction of the present disclosure is improved to form more valuable products. Dibenzothiophene sulfone was chosen as a model sulfur compound because most of the sulfur in an average diesel fuel is in the form of substituted or unsubstituted dibenzothiophene. Equation (1) illustrates how hydroxide attacks the sulfur atom of dibenzothiophene sulfone (A), forming biphenyl-2-sulfonate (B). Equation (2) illustrates how hydroxide may attack B at the carbon atom adjacent to the sulfur atom, forming biphenyl-2-ol (C) and sulfite salts (D). Compound C may ionize in basic media, and may dissolve in the aqueous or molten salt layer. Equation (3) illustrates how hydroxide may attack the sulfur atom of B to form biphenyl (E) and sulfate salts (F). Equation (4) illustrates how, in the presence of a primary alcohol, including, but not limited to, methanol, methoxide ions generated in-situ may attack the carbon atom, forming ether compounds, such as 2-methoxybiphenyl (G). Equation (5) illustrates the reaction of dibenzothiophene sulfone with alkoxides alone, not in the presence of hydroxide, as taught by Aida et al, to form biphenyl-2-methoxy-2'-sulfinate salt (H), which may be substantially soluble in the caustic. Using aqueous or molten hydroxide without the presently disclosed selectivity promoter will cause reaction (1) to occur, followed predominantly by reaction (2). When the vicinal diol selectivity promoter disclosed herein is used, reaction (1) occurs, followed predominantly by reaction (3). When the primary selectivity promoter (alcohol) disclosed herein is used, reaction (1) occurs, followed predominantly by reaction (4). It can be seen that the hydrogen atoms that become attached to biphenyl come from hydroxide. When water is used in the regeneration of the caustic, the ultimate source of the hydrogen atoms added to the biphenyl may be water.

The following non-limiting examples illustrate certain aspects of the present invention.

EXAMPLES

Example 1

Preparation of Pelletized Polymeric Titanyl Catalyst

A dimethyl sulfoxide (DMSO) solution of co-monomer (e.g. 4,4'-bisphenol A dianhydride (BPADA)) is prepared and is combined with a DMSO solution of the titanyl (e.g. bis (glycerol)oxotitanium(IV)) with stirring at 70° C. for about 4 hrs to produce a copolymer solution. Then, the solution is cooled to room temperature, and the polymer product is precipitated with excess acetone. The polymeric precipitate is collected by vacuum filtration and is dried. The yield of precipitated polymeric titanyl catalyst is greater than 90%.

A blend of bonding agent (Kynar®), optional inert filler (silica or alumina), and the polymeric titanyl catalyst is prepared in a solid mixer or blender. The blended mixture is then extruded or pelletized by compression producing uniform catalyst pellets with hardness test strength preferably greater than 2 kp.

Example 2

Continuous Catalytic Removal of Heteroatoms from a Heteroatom-Contaminated Light Atmospheric Gas Oil Straight-run light atmospheric gas oil (LAGO) (3.45% sulfur) and cumene hydroperoxide (30% in cumene, fed at a rate of 2.1 mole equivalents to sulfur in LAGO feed) are fed to a fixed bed reactor containing pelletized titanyl polymeric catalyst, prepared in accordance with Example 1, at about 85° C. with a combined LHSV of about 1.0 $hr^{-1}$ producing a first intermediate stream. The first intermediate stream is vacuum distilled at −25 in Hg to remove and recover a low boiling distillate comprising cumene, cumyl alcohol, alpha-methylstyrene, and acetophenone from a heavy second intermediate stream. The heavy second intermediate stream essentially comprises light atmospheric gas oil with oxidized heteroatom compounds. The second intermediate stream is then fed into a heated reactor wherein it combines with a feed stream containing caustic and ethylene glycol (the combined liquid residence time is 1.0 $hr^{-1}$) to produce a biphasic mixture that exits the reactor. The biphasic mixture is then separated by gravity to produce a light phase product comprising essentially heteroatom-free LAGO and a heavy phase by-product stream comprising essentially caustic, ethylene glycol, and heteroatom-containing salts. Sulfur removal from the light phase product is greater than 50%, nitrogen removal is greater than 50%, vanadium removal is greater than 50%, nickel removal is greater than 50%, and iron removal is greater than 50% when the samples are measured for elemental composition and compared against the LAGO feed composition. The heavy phase by-product is further treated according to known methods to recover and recycle the caustic and ethylene glycol from the heteroatom by-products.

Examples 3-12

Desulfonylation Using Hydroxide and Various Alcohols

A mixture of dibenzothiophene sulfone in 1,2,3,4-tetrahydronaphthalene is reacted with six molar equivalents of various alcohols, three molar equivalents sodium hydroxide, and three molar equivalents potassium hydroxide. Reactions are performed at 275° C. for one hour. The products of the reaction are acidified with aqueous hydrochloric acid, and then extracted with dichloromethane. The dichloromethane extract is analyzed by high pressure liquid chromatography (HPLC) to determine percent conversion of dibenzothiophene sulfone, and mole percent yield of biphenyl and ortho-phenylphenol. The results are given below in Table 1.

| Example | Alcohol | Biphenyl | o-Phenyl-phenol | Conversion |
|---|---|---|---|---|
| 3 | None | 7% | 64% | 93% |
| 4 | Ethylene Glycol | 65% | 9% | 89% |
| 5 | Propylene Glycol | 37% | 17% | 99% |
| 6 | Glycerol | 41% | 51% | 99% |
| 7 | 1,3-Propanediol | 16% | 45% | 95% |
| 8 | Pinacol | 13% | 56% | 100% |
| 9 | Ethanolamine | 20% | 21% | 100% |
| 10 | Diethanolamine | 47% | 27% | 97% |
| 11 | Triethanolamine | 41% | 32% | 100% |
| 12 | 4-(2-hydroxy-ethyl)morpholine | 8% | 31% | 100% |

Examples 13-26

Desulfonylation Using Phenoxide and Various Alcohols

A mixture of dibenzothiophene sulfone in 1,2,3,4-tetrahydronaphthalene is reacted with six molar equivalents of various alcohols, and six molar equivalents of sodium phenoxide monohydrate. Reactions are performed at 300° C. for fifteen minutes. The products of the reaction are acidified with aqueous hydrochloric acid, and then extracted with dichloromethane. The dichloromethane extract is analyzed by HPLC to determine percent conversion of dibenzothiophene sulfone, and mole percent yield of biphenyl and ortho-phenylphenol. The results are given below in Table 2.

| Example | Alcohol | Biphenyl | o-Phenyl-phenol | Conversion |
|---|---|---|---|---|
| 13 | None | 1% | 5% | 77% |
| 14 | Ethylene Glycol | 23% | 59% | 97% |
| 15 | Propylene Glycol | 32% | 20% | 97% |
| 16 | Glycerol | 19% | 18% | 59% |
| 17 | 1,3-Propanediol | 25% | 7% | 79% |
| 18 | Pinacol | 4% | 4% | 35% |
| 19 | Ethanolamine | 23% | 18% | 91% |
| 20 | Diethanolamine | 20% | 50% | 85% |
| 21 | Triethanolamine | 19% | 26% | 100% |
| 22 | 4-(2-hydroxy-ethyl)morpholine | 5% | 33% | 71% |
| 23 | Methanol | 15% | 9% | 42% |

-continued

| Example | Alcohol | Biphenyl | o-Phenyl-phenol | Conversion |
|---|---|---|---|---|
| 24 | t-Butanol | 10% | 9% | 42% |
| 25 | Catechol | 0% | 0% | 0% |
| 26 | Hydroquinone | 40% | 5% | 95% |

Examples 27-38

Desulfonylation Using Acetate and Various Alcohols

A mixture of dibenzothiophene sulfone in 1,2,3,4-tetrahydronaphthalene is reacted with six molar equivalents of various alcohols, and six molar equivalents of a salt mixture comprising 57 mole % cesium acetate and 43 mole % potassium acetate. Reactions are performed at 300° C. for fifteen minutes. The products of the reaction are acidified with aqueous hydrochloric acid, and then extracted with dichloromethane. The dichloromethane extract is analyzed by HPLC to determine percent conversion of dibenzothiophene sulfone, and mole percent yield of biphenyl and ortho-phenylphenol. The results are given below in Table 3.

| Example | Alcohol | Biphenyl | o-Phenyl-phenol | Conversion |
|---|---|---|---|---|
| 27 | None | 0% | 0% | 0% |
| 28 | Ethylene Glycol | 19% | 6% | 35% |
| 29 | Propylene Glycol | 26% | 3% | 88% |
| 30 | Glycerol | 3% | 2% | 70% |
| 31 | 1,3-Propanediol | 12% | 7% | 84% |
| 32 | Pinacol | 0% | 0% | 54% |
| 33 | Ethanolamine | 24% | 5% | 50% |
| 34 | Diethanolamine | 35% | 9% | 69% |
| 35 | Triethanolamine | 41% | 13% | 79% |
| 36 | Cellulose Powder | 14% | 0% | 25% |
| 37 | Methanol | 8% | 5% | 37% |
| 38 | t-Butanol | 0% | 0% | 11% |

Examples 39-45

Desulfonylation Using Ethylene Glycol and Various Nucleophiles

A mixture of dibenzothiophene sulfone in 1,2,3,4-tetrahydronaphthalene is reacted with six molar equivalents of ethylene glycol, and six molar equivalents of various nucleophiles. Example 41 used the following molar equivalents to dibenzothiophene sulfone: 1.8 molar equivalents sodium hydroxide, 1.8 molar equivalents potassium hydroxide, 0.7 molar equivalents sodium sulfide nonahydrate and 3.5 molar equivalents ethylene glycol. Reactions are performed at 300° C. for fifteen minutes. The products of the reaction are acidified with aqueous hydrochloric acid, and then extracted with dichloromethane. The dichloromethane extract is analyzed by HPLC to determine percent conversion of dibenzothiophene sulfone, and mole percent yield of biphenyl and ortho-phenylphenol. The results are given below in Table 4.

| Example | Nucleophile | Biphenyl | o-Phenyl-phenol | Conversion |
|---|---|---|---|---|
| 39 | None | 0 | 0 | 0 |
| 40 | Sodium sulfide nonahydrate | 55 | 3 | 87 |
| 41 | Sodium sulfide nonahydrate, sodium hydroxide, potassium hydroxide | 76 | 13 | 98 |
| 42 | Potassium t-butoxide | 40 | 23 | 100 |
| 43 | Sodium methoxide | 3 | 0 | 69 |
| 44 | Sodium hydrosulfide | 3 | 0 | 89 |
| 45 | Sodium thiophenolate monohydrate | 4 | 3 | 98 |

Examples 46-48

Desulfonylation Using Hydroxide, Sulfide, and Ethylene Glycol

A mixture of an aromatic sulfone in 1,2,3,4-tetrahydronaphthalene is reacted with 3.5 molar equivalents of ethylene glycol, 1.8 molar equivalents of a sodium hydroxide, 1.8 molar equivalents of potassium hydroxide, and 0.7 molar equivalents of sodium sulfide nonahydrate. Reactions are performed at 275° C. for sixty minutes. The products of the reaction are acidified with aqueous hydrochloric acid, and then extracted with dichloromethane. The dichloromethane extract is analyzed by HPLC to determine percent conversion of sulfone, and mole percent yield of organic products as compared to the initial moles of starting sulfone. The results are given below in Table 5.

| Example | Sulfone | Conversion | Products (mole percent) |
|---|---|---|---|
| 46 | Diphenyl sulfone | 16% | Benzene (6%)<br>Phenol (0.7%) |
| 47 | Thianthrene disulfone | 100% | Benzene (99%)<br>Phenol (30%)<br>Biphenyl (0.3%)<br>Dibenzothiophene sulfone (3%) |
| 48 | Benzothiophene sulfone | 100% | Styrene (1.3%) |

Examples 49-51

Desulfonylation Using Phenoxide, and Propylene Glycol

A mixture of an aromatic sulfone in 1,2,3,4-tetrahydronaphthalene is reacted with six molar equivalents of propylene glycol, and six molar equivalents of sodium phenoxide monohydrate. Reactions are performed at 275° C. for sixty minutes. The products of the reaction are acidified with aqueous hydrochloric acid, and then extracted with dichloromethane. The dichloromethane extract is analyzed by HPLC to determine percent conversion of sulfone, and mole percent yield of organic products as compared to the initial moles of starting sulfone. The results are given below in Table 6.

| Example | Sulfone | Conversion | Products (mole percent) |
|---|---|---|---|
| 49 | Diphenyl sulfone | 32% | Benzene (61%)<br>Biphenyl (1%) |
| 50 | Thianthrene disulfone | 100% | Benzene (78%)<br>Diphenyl sulfone (3%)<br>Dibenzothiophene sulfone (0.5%) |
| 51 | Benzothiophene sulfone | 100% | Styrene (17%) |

Examples 52-54

Desulfonylation Using Acetate and Triethanolamine

An aromatic sulfone is reacted with twelve molar equivalents of triethanolamine, and twelve molar equivalents of a salt mixture comprised of 57 mole % cesium acetate and 43 mole % potassium acetate. Reactions are performed at 275° C. for sixty minutes. The products of the reaction are acidified with aqueous hydrochloric acid, and then extracted with dichloromethane. The dichloromethane extract is analyzed by HPLC to determine percent conversion of sulfone, and mole percent yield of organic products as compared to the initial moles of starting sulfone. The results are given below in Table 7.

| Example | Sulfone | Conversion | Products (mole percent) |
|---|---|---|---|
| 52 | Diphenyl sulfone | 69% | Benzene (118%)<br>Biphenyl (1%)<br>Phenol (2%)<br>Dibenzothiophene sulfone (2%) |
| 53 | Thianthrene disulfone | 100% | Benzene (30%)<br>Phenol (3%)<br>Diphenyl sulfone (29%)<br>Dibenzothiophene sulfone (5%)<br>Biphenyl (1%)<br>Benzene sulfonate (29%)<br>Dibenzothiophene (3) |
| 54 | Benzothiophene sulfone | 100% | Styrene (13%) |

Example 55

Oxidation of Nitrogen Compounds

The oxidation of model nitrogen compounds (e.g., pyridine, quinolone, isoquinoline) was carried out by first dissolving the compounds to a dilution of 3 mg/g in 35% tert-butyl hydroperoxide in toluene. The samples were then heated in a water bath to 95° C. Once this temperature was reached, silica supported titanyl catalyst was added at a ratio of 1 ml catalyst to 1 g oxidant. Lastly, the solutions were lightly agitated at 95° C. for a maximum of 4 hours, in which full conversion of nitrogen compound to N-oxide was observed.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the above described invention.

The invention claimed is:

1. A method of upgrading an oxidized-heteroatom-containing hydrocarbon feed by removing oxidized-heteroatom contaminants, the method comprising:

contacting one of sulfoxide, sulfone, sulfonate, and sulfonic acid, and combinations thereof in the oxidized-heteroatom-containing hydrocarbon feed with a second feed comprising at least one caustic and at least one selectivity promoter to form a first intermediate stream; and removing the oxidized heteroatom contaminants from the first intermediate stream.

2. The method of claim 1, wherein the oxidized-heteroatom-containing hydrocarbon feed is an unrefined crude oil.

3. The method of claim 1, wherein the at least one caustic and at least one selectivity promoter are recovered for reuse.

4. The method of claim 1, wherein the oxidized heteroatom contaminants comprise sulfites, sulfates or a combination thereof.

5. The method of claim 1, wherein the oxidized heteroatom contaminants comprise sulfates.

6. The method of claim 1, wherein the selectivity promoter has a pKa value, as measured in DMSO, in the range of from about 9 to about 32.

7. The method of claim 1, wherein the selectivity promoter is at least one of ethylene glycol and propylene glycol.

8. The method of claim 1, wherein the at least one selectivity promoter comprises an organic alcohol.

9. A method of upgrading an oxidized-heteroatom-containing hydrocarbon feed by removing oxidized-heteroatoms contaminants, the method comprising:

separating one of sulfoxide, sulfone, sulfonate, and sulfonic acid, and combinations thereof from an oxidized-heteroatom-containing hydrocarbon feed to form a first intermediate stream;

contacting the first intermediate stream with a second stream comprising at least one caustic and at least one selectivity promoter to form a second intermediate stream; and removing the oxidized heteroatom contaminants from the second intermediate stream.

10. The method of claim 9, wherein the first intermediate stream is obtained by solvent extraction.

11. The method of claim 9, wherein the oxidized-heteroatom-containing hydrocarbon feed is an unrefined crude oil.

12. The method of claim 9, wherein the at least one caustic and at least one selectivity promoter are recovered for reuse.

13. The method of claim 9, wherein the oxidized heteroatom contaminants comprise sulfites, sulfates or a combination thereof.

14. The method of claim 9, wherein the oxidized heteroatom contaminants comprise sulfates.

15. The method of claim 9, wherein the selectivity promoter has a pKa value, as measured in DMSO, in the range of from about 9 to about 32.

16. The method of claim 9, wherein the selectivity promoter is at least one of ethylene glycol and propylene glycol.

17. The method of claim 9, wherein the at least one selectivity promoter comprises an organic alcohol.

18. A method of upgrading an oxidized-heteroatom-containing hydrocarbon feed by removing oxidized-heteroatom contaminants, the method comprising:

contacting one of amine oxide, a nitrate, a nitro compound, and combinations thereof in an oxidized-heteroatom-containing hydrocarbon feed with a second stream comprising at least one caustic and at least one selectivity promoter to form a first intermediate stream; and removing the oxidized heteroatom contaminants from the first intermediate stream.

19. The method of claim 18, wherein the oxidized-heteroatom-containing hydrocarbon feed is an unrefined crude oil.

20. The method of claim 18, wherein the at least one caustic and at least one selectivity promoter are recovered for reuse.

* * * * *

UNITED STATES PATENT AND TRADEMARK OFFICE

CERTIFICATE OF CORRECTION

PATENT NO. : 9,206,359 B2
APPLICATION NO. : 14/287916
DATED : December 8, 2015
INVENTOR(S) : Litz et al.

It is certified that error appears in the above-identified patent and that said Letters Patent is hereby corrected as shown below:

Page 2, under item (63), Related U.S. Application Data, third line down, "Oct. 31, 2001" should be "Oct. 31, 2008".

Signed and Sealed this
Fifth Day of April, 2016

Michelle K. Lee

Michelle K. Lee
*Director of the United States Patent and Trademark Office*